US008316963B2

(12) United States Patent
Eia et al.

(10) Patent No.: US 8,316,963 B2
(45) Date of Patent: Nov. 27, 2012

(54) CUTTINGS PROCESSING SYSTEM

(75) Inventors: Jan Thore Eia, Kvernaland (NO); Gordon M. Logan, Aberdeen (GB)

(73) Assignee: M-I LLC, Houston, TX (US)

( * ) Notice: Subject to any disclaimer, the term of this patent is extended or adjusted under 35 U.S.C. 154(b) by 755 days.

(21) Appl. No.: 12/020,143

(22) Filed: Jan. 25, 2008

(65) Prior Publication Data

US 2008/0179090 A1 Jul. 31, 2008

Related U.S. Application Data

(60) Provisional application No. 60/887,514, filed on Jan. 31, 2007.

(51) Int. Cl.
*E21B 7/12* (2006.01)
*E21B 21/06* (2006.01)

(52) U.S. Cl. ..... 175/5; 175/206; 175/207; 166/357; 166/358

(58) Field of Classification Search ..... 166/358, 166/357, 267, 75.15; 175/46, 88, 209, 206, 175/207, 5, 48
See application file for complete search history.

(56) References Cited

U.S. PATENT DOCUMENTS

| | | | | |
|---|---|---|---|---|
| 5,055,180 | A * | 10/1991 | Klaila | 208/402 |
| 5,129,469 | A | 7/1992 | Jackson | |
| 5,303,786 | A | 4/1994 | Prestridge et al. | |
| 5,814,230 | A * | 9/1998 | Willis et al. | 210/710 |
| 5,913,372 | A * | 6/1999 | Dietzen | 175/66 |
| 6,179,071 | B1 | 1/2001 | Dietzen | |
| 6,213,227 | B1 * | 4/2001 | Dietzen | 175/66 |
| 6,321,860 | B1 | 11/2001 | Reddoch | |
| 6,345,672 | B1 * | 2/2002 | Dietzen | 175/66 |
| 6,698,989 | B2 | 3/2004 | Snowdon et al. | |
| 6,702,539 | B2 | 3/2004 | Snowdon et al. | |
| 6,709,206 | B1 | 3/2004 | Andes et al. | |
| 6,709,216 | B2 | 3/2004 | Snowdon et al. | |
| 6,745,856 | B2 * | 6/2004 | Simpson et al. | 175/66 |
| 6,881,349 | B2 | 4/2005 | Mueller et al. | |
| 6,977,048 | B2 | 12/2005 | Mueller et al. | |
| 6,988,567 | B2 * | 1/2006 | Burnett et al. | 175/66 |
| 7,484,574 | B2 * | 2/2009 | Burnett et al. | 175/66 |
| 7,493,969 | B2 * | 2/2009 | Burnett et al. | 175/88 |
| 7,622,693 | B2 * | 11/2009 | Foret | 219/121.43 |
| 2004/0011562 | A1 * | 1/2004 | Simpson et al. | 175/66 |
| 2005/0205477 | A1 | 9/2005 | Eriksen | |

FOREIGN PATENT DOCUMENTS

WO 9904134 1/1999

OTHER PUBLICATIONS

PCT International Search Report issued in PCT Application No. PCT/US2008/052526 dated Jul. 28, 2008 (4 pages). PCT Written Opinion issued in PCT Application No. PCT/US2008/052526 dated Jul. 28, 2008 (4 pages).
Office Action issued in corresponding Indonesian Patent Application No. W-00200902093 with English language communication reporting the same; Dated Dec. 10, 2010 (5 pages).
Substantive Examination Report issued in corresponding Malaysian Application No. PI 20093125; Dated Jul. 15, 2011 (4 pages).

* cited by examiner

*Primary Examiner* — Matthew Buck
(74) *Attorney, Agent, or Firm* — Osha Liang LLP

(57) ABSTRACT

A method for using a vessel assembly including two or more vessels in multiple drilling unit operations, the method including using a vessel in the container assembly for cuttings storage, and operating at least one vessel in the container system in at least two of a slurrification system, a drilling fluid recycling system, and a tank cleaning system.

18 Claims, 12 Drawing Sheets

CUTTINGS PROCESSING SYSTEM

CROSS-REFERENCE TO RELATED APPLICATION

This application, pursuant to 35 U.S.C. §119(e), claims priority to U.S. Provisional Application Ser. Nos. 60/887,514 filed Jan. 31, 2007. That application is incorporated by reference in its entirety.

BACKGROUND OF THE DISCLOSURE

1. Field of the Disclosure

Embodiments disclosed herein relate generally to integrating a vessel used for cuttings storage and/or transport with a second operation performed on a rig. More specifically, embodiments disclosed herein relate to use of a cuttings storage vessel in one or more of a cuttings storage/transport system, a tank cleaning system, a slurrification system, and a drilling fluid recycling system.

2. Background

In the drilling of wells, a drill bit is used to dig many thousands of feet into the earth's crust. Oil rigs typically employ a derrick that extends above the well drilling platform. The derrick supports joint after joint of drill pipe connected end-to-end during the drilling operation. As the drill bit is pushed further into the earth, additional pipe joints are added to the ever lengthening "string" or "drill string". Therefore, the drill string typically includes a plurality of joints of pipe.

Fluid "drilling mud" is pumped from the well drilling platform, through the drill string, and to a drill bit supported at the lower or distal end of the drill string. The drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the platform, it is contaminated with small pieces of shale and rock that are known in the industry as well cuttings or drill cuttings. Once the drill cuttings, drilling mud, and other waste reach the platform, a "shale shaker" is typically used to remove the drilling mud from the drill cuttings so that the drilling mud may be reused. The remaining drill cuttings, waste, and residual drilling mud are then transferred to a holding trough for disposal. In some situations, for example with specific types of drilling mud, the drilling mud may not be reused and it must also be disposed. Typically, the non-recycled drilling mud is disposed of separate from the drill cuttings and other waste by transporting the drilling mud via a vessel to a disposal site.

The disposal of the drill cuttings and drilling mud is a complex environmental problem. Drill cuttings contain not only the residual drilling mud product that would contaminate the surrounding environment, but may also contain oil and other waste that is particularly hazardous to the environment, especially when drilling in a marine environment.

In the Gulf of Mexico, for example, there are hundreds of drilling platforms that drill for oil and gas by drilling into the subsea floor. These drilling platforms can be used in places where the depth of the water can be many hundreds of feet. In such a marine environment, the water is typically filled with marine life that cannot tolerate the disposal of drill cuttings waste. Therefore, there is a need for a simple, yet workable solution to the problem of disposing of well drill cuttings, drilling mud, and/or other waste in offshore marine environments and other fragile environments.

Traditional methods of disposal have been dumping, bucket transport, cumbersome conveyor belts, screw conveyors, and washing techniques that require large amounts of water. Adding water creates additional problems of added volume and bulk, and transport problems. Installing conveyors requires major modification to the rig area and involves extensive installation hours and expense.

Another method of disposal includes returning the drill cuttings, drilling mud, and/or other waste via injection under high pressure into an earth formation. Generally, the injection process involves preparation of a slurry within surface-based equipment and pumping the slurry into a well that extends relatively deep underground into a receiving stratum or adequate formation. Material to be injected back into a formation may be prepared into a slurry acceptable to high pressure pumps used in pumping material down a well. The particles are usually not uniform in size and density, thus making the slurrification process complicated. If the slurry is not the correct density, the slurry often plugs circulating pumps. The abrasiveness of the material particles may also abrade the pump impellers causing cracking. Some centrifugal pumps may be used for grinding the injection particles by purposely causing pump cavitations.

The basic steps in the injection process include the identification of an appropriate stratum or formation for the injection; preparing an appropriate injection well; formulation of the slurry, which includes considering such factors as weight, solids content, pH, gels, etc.; performing the injection operations, which includes determining and monitoring pump rates such as volume per unit time and pressure; and capping the well.

In some instances, the cuttings, which are still contaminated with some oil, are transported from a drilling rig to an offshore rig or ashore in the form of a very thick heavy paste for injection into an earth formation. Typically the material is put into special skips of about 10 ton capacity which are loaded by crane from the rig onto supply boats. This is a difficult and dangerous operation that may be laborious and expensive.

U.S. Pat. No. 6,179,071 discloses that drill cuttings may be stored in a holding tank or multiple tanks on a drilling rig. The holding tank is then connected to a floating work boat with a discharge flow line. Cuttings may then be transferred to the boat via the flow line.

U.S. Pat. No. 6,709,216 and related patent family members disclose that cuttings may also be conveyed to and stored in an enclosed, transportable vessel, where the vessel may then be transported to a destination, and the drill cuttings may be withdrawn. The transportable storage vessel has a lower conical section structured to achieve mass flow of the mixture in the vessel, and withdrawal of the cuttings includes applying a compressed gas to the cuttings in the vessel. The transportable vessels are designed to fit within a 20 foot ISO container frame. These conical vessels will be referred to herein as ISO-vessels.

As described in U.S. Pat. No. 6,709,216 and family, the ISO vessels may be lifted onto a drilling rig by a rig crane and used to store cuttings. The vessels may then be used to transfer the cuttings onto a supply boat. The vessels may also serve as buffer storage while a supply boat is not present. Alternatively, the storage vessels may be lifted off the rig by cranes and transported by a supply boat.

Space on offshore platforms is limited. In addition to the storage and transfer of cuttings, many additional operations take place on a drilling rig, including tank cleaning, slurrification operations, drilling, chemical treatment operations, raw material storage, mud preparation, mud recycle, mud separations, and many others.

Due to the limited space, it is common to modularize these operations and to swap out modules when not needed or when space is needed for the equipment. For example, cuttings containers may be offloaded from the rig to make room for modularized equipment used for tank cleaning operations. Modularized tank cleaning operations may include a water recycling unit of an automatic tank cleaning system, such as described in U.S. Patent Application Publication No. 20050205477, assigned to the assignees of the present invention and hereby fully incorporated by reference.

In other drilling operations, cuttings containers may be offloaded from the rig to make room for environmental and/or drilling fluid recycling systems. Such systems may include a number of mixing, flocculating, and storage tanks to clean industrial wastewater produced during drilling or shipping operations. Examples of such environmental and drilling fluid recycling methods and systems are disclosed in U.S. Pat. Nos. 6,881,349 and 6,977,048, assigned to the assignee of the present application, and hereby incorporated in their entirety.

In other drilling operations, cuttings containers may be offloaded from the rig to make room for modularized equipment used for slurrification processes. Slurrification systems may be disposed in portable units that may be transported from one work site to another. As disclosed in U.S. Pat. No. 5,303,786, a slurrification system may be mounted on a semi-trailer that may be towed between work sites. The system includes, inter alia, multiple tanks, pumps, mills, grinders, agitators, hoppers, and conveyors. As discussed in U.S. Pat. No. 5,303,786, the slurrification system may be moved to a site where a large quantity of material to be treated is available, such as existing or abandoned reserve pits that hold large quantities of cuttings.

Slurrification systems that may be moved onto a rig are typically large modules that are fully self-contained, receiving cuttings from a drilling rig's fluid mud recovery system. For example, PCT Publication No. WO 99/04134 discloses a process module containing a first slurry tank, grinding pumps, a system shale shaker, a second slurry tank, and optionally a holding tank. The module may be lifted by a crane on to an offshore drilling platform.

The lifting operations required to swap modular systems, as mentioned above, may be difficult, dangerous, and expensive. Additionally, many of these modularized operations are self-contained, and therefore include redundant equipment, such as pumps, valves, and tanks or storage vessels.

There exists a need for more efficient use of deck space and equipment. Additionally, there exists a need to minimize the number or size of lifts to or from a rig. Accordingly, there is a continuing need for systems and methods for efficiently cleaning tanks, recycling drilling fluid, and preparing slurries for cuttings re-injection, as well as recovering and recycling fluids used during these operations, at a drilling location.

SUMMARY OF THE DISCLOSURE

In one aspect, embodiments disclosed herein relate to a method for using a vessel assembly including two or more vessels in multiple drilling unit operations. The method may include using a vessel in the container assembly for cuttings storage, and operating at least one vessel in the container system in at least two of a slurrification system, a drilling fluid recycling system, and a tank cleaning system.

In another aspect, embodiments disclosed herein relate to a method for converting a vessel assembly including two or more vessels for use in multiple operations at a drill site. The method may include fluidly connecting at least one module to the vessel assembly, wherein the at least one module includes at least one of a tank cleaning conversion module, a drilling fluid recycling conversion module, and a slurrification conversion module.

In another aspect, embodiments disclosed herein relate to a method for converting a vessel assembly including two or more vessels for use in multiple operations at a drill site. The method may include fluidly connecting a module to the vessel assembly, wherein the at least one module includes a valve for directing a fluid between a first vessel of the vessel assembly and a second vessel of the vessel assembly, and a filter system for filtering the fluid.

Other aspects and advantages will be apparent from the following description and the appended claims.

DETAILED DESCRIPTION

In one aspect, embodiments disclosed herein relate to systems and methods for transporting drill cuttings, recycling drilling fluid, slurrification of drill cuttings, and cleaning tanks at drilling locations. Drilling locations may include both on-shore and off-shore drill sites, as well as, in certain embodiments, system components not connected to drilling apparatus. Additionally, embodiments disclosed herein relate to systems and methods for these operations using module-based systems to enable use of a drill cuttings storage vessel(s) in at least two of these operations. More specifically, such embodiments relate to using a module-based system to convert cuttings storage and transfer vessels into components of drilling fluid recycling systems, tank cleaning systems, and/or drill cuttings slurrification systems.

Figure 1:
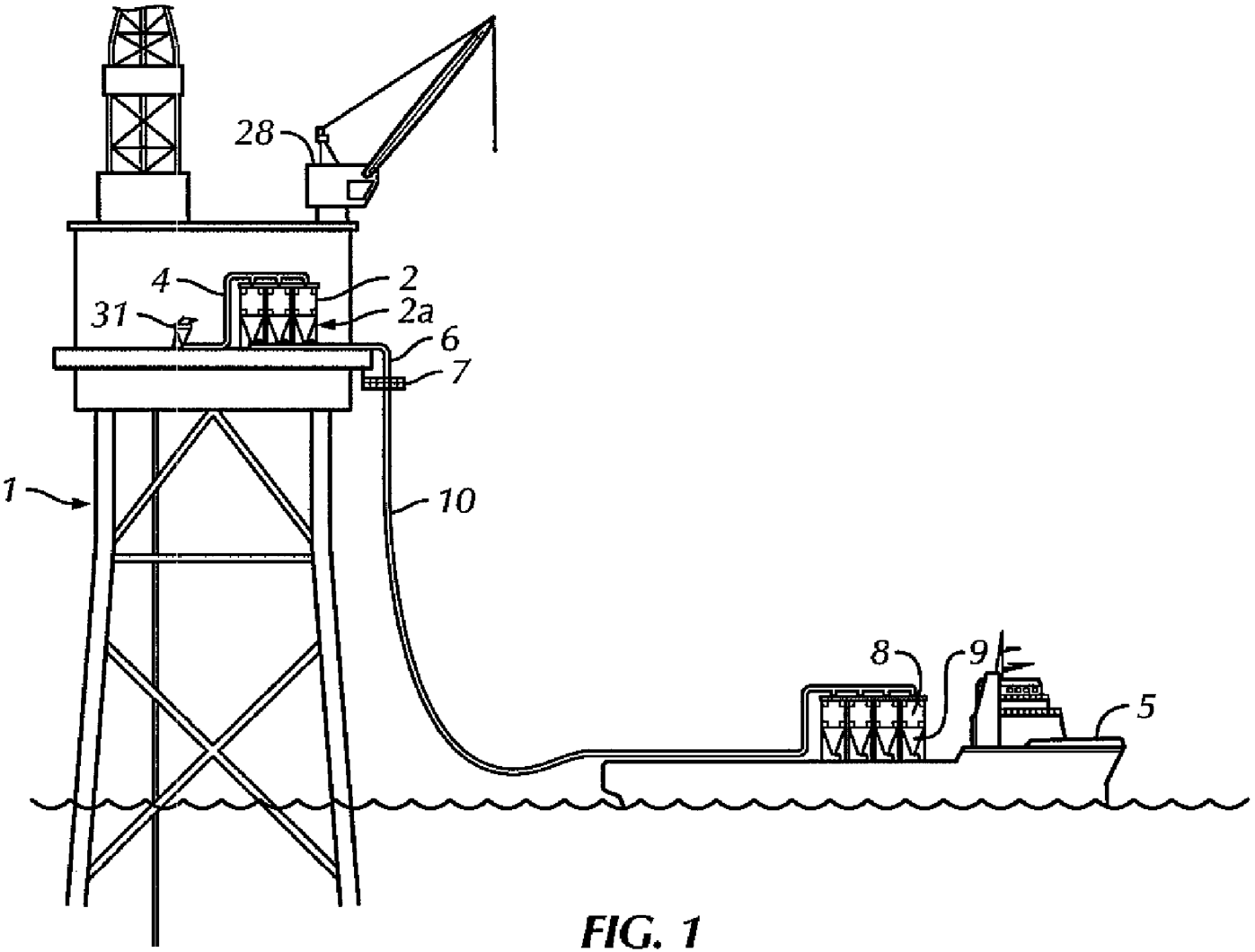
FIG. 1 is a schematic diagram illustrating a cuttings transfer system useful in embodiments disclosed herein.

Referring to FIG. 1, a method of offloading drill cuttings from an off-shore drilling rig according to one embodiment of the present disclosure is shown. In this embodiment, an off-shore oil rig 1 may have one or more vessels 2 located on its platform. Vessels 2, in various embodiments, may include raw material storage tanks, waste storage tanks, or any other vessels commonly used in association with drilling processes. In other embodiments, vessels 2 may include cuttings boxes, tanks, and ISO-PUMPS (a trademark of MI LLC, Houston, Tex.). In some embodiments, vessels 2 may include one or more drill cuttings storage tanks fluidly connected to allow the transfer of cuttings therebetween. Such cuttings storage vessels 2 may be located within a support framework (not shown), such as an ISO container frame. As such, those of ordinary skill in the art will appreciate that vessels 2 may be used for both drill cutting storage and transport.

In some embodiments, a vessel assembly may include two or more cuttings storage vessels. As illustrated in FIG. 1, vessel assembly 2A includes three cuttings storage vessels. In some embodiments, the vessels 2 in vessel assembly 2A may include fluid connections between the individual vessels 2, as well as common inlets and common outlets for fluid connections with the vessels 2 in vessel assembly 2A.

Drill cuttings generated during the drilling process may be transmitted to the vessels 2 for storage and/or subsequent transfer in a number of different ways. One such method of transferring drill cuttings is via a pneumatic transfer system including a cuttings blower 3 and pneumatic transfer lines 4, such as disclosed in U.S. Pat. Nos. 6,698,989, 6,702,539, and 6,709,216, hereby incorporated by reference herein. However, those of ordinary skill in the art will appreciate that other methods for transferring cuttings to storage vessels 2 may include augers, conveyors, and pneumatic suction systems.

When cuttings need to be offloaded from a rig 1 to supply boat 5, cuttings may be discharged through pipe 6 to a hose connection pipe 7. A supply boat 5, having one or more containers 8, may be brought close to oil rig 1. Supply boat 5 may be fitted with a storage assembly 8 that may include a number of additional cuttings storage vessels 9, including, for example, pneumatic conveying vessels. A flexible hose 10 may be connected to pipe 6 at hose connection pipe 7. In this embodiment, flexible hose 10 connects storage assembly 8 to cuttings storage vessels 2 via connection pipe 7.

Figure 2:
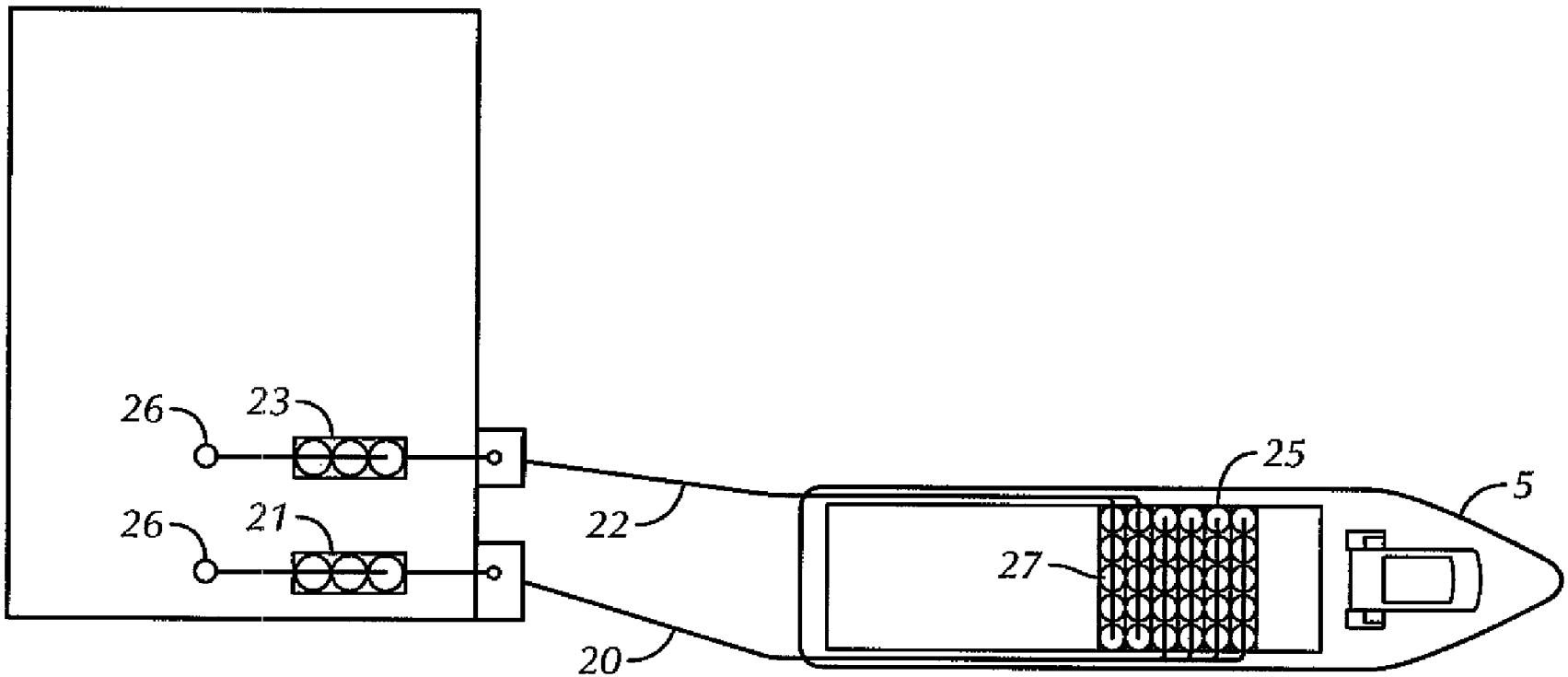
FIG. 2 shows a top view of a system for transferring material from an off-shore rig in accordance with an embodiment of the present disclosure.

In one embodiment, as shown in FIG. 2, two discrete streams of materials may be transferred contemporaneously (i.e., at least partially during the same time interval) to a transport vehicle, for example, supply boat 5. In this embodiment, a first supply line 20 may transfer a first material from at least a first storage vessel 21 to supply boat 5 and a second supply line 22 may transfer a second material from at least a second storage vessel 23 to supply boat 5. The first and second materials may be transferred to a cuttings storage assembly 25 disposed on supply boat 5. Alternatively, the first and second materials may be transferred to separate storage vessels; for example the first and/or second material may be transferred to a storage tank (not shown) disposed on or below the deck of supply boat 5.

In one embodiment, the first material may include dry cuttings, while the second material may include a fluid. One of ordinary skill in the art will appreciate that a fluid may include a liquid, slurry, or gelatinous material. Additionally, one of ordinary skill in the art will appreciate that dry cuttings may include cuttings processed by a separatory, thermal treatment, or cleaning system, and as such, may include small amounts of residual fluids, hydrocarbons, and/or other chemical additives used during the cleaning process. Pumps (not shown) may be coupled to the storage vessels 21, 23 to facilitate the transfer of material, including, for example, dry cuttings, a fluid, or a slurry, from a separatory, thermal treatment, or cleaning operation on the rig to supply boat 5. Alternatively, a pneumatic transfer system 26 may be coupled to the storage vessels 21, 23 to transfer materials, including dry cuttings, fluids, and slurries, to the supply boat 5. In one embodiment, the pneumatic transfer system 26 may include a forced flow pneumatic transfer system as disclosed in U.S. Pat. Nos. 6,698,989, 6,702,539, and 6,709,216. Providing contemporaneous transfer of discrete material streams (e.g., dry cuttings, fluids), may reduce the transportation time between a rig and a transport vehicle, such as, supply boat 5.

In one embodiment, cuttings storage assembly 25 may include at least one cuttings storage vessel 27. As such, the first material and the second material may be transferred to a single cuttings storage vessel 27 of cuttings storage assembly 25. In another embodiment, the first material and the second material may be transferred to separate cuttings storage vessels 27 of cuttings storage assembly 25. In one embodiment, a cutting storage vessel 27 disposed on the supply boat 5 may be used in a slurrification system, as disclosed below with reference to cuttings storage vessels disposed on a rig. In this embodiment, briefly, a module (not shown) may be operatively connected to the cuttings storage assembly 25 to incorporate existing cuttings storage vessels 27 into a slurrification system.

Referring again to FIG. 1, as described above with respect to prior art methods, when cuttings storage vessels 2 are no longer needed during a drilling operation, or are temporarily not required for operations taking place at the drilling location, the cuttings storage vessels 2 may be offloaded to a supply boat 5. Other systems and vessels for performing different operations may then be lifted onto the rig 1 via crane 28, and placed where vessels 2 were previously located. In this manner, valuable rig space may be saved; however, conserving space in this manner may require multiple dangerous and costly crane lifts.

In contrast to the prior art methods, embodiments disclosed herein use cuttings storage vessels in two or more operations that are performed on a drilling rig. In one aspect, embodiments disclosed herein relate to operating a vessel in at least two operations performed on a rig. In some aspects, embodiments disclosed herein relate to using a vessel in both cuttings storage/transfer operations and a second operation. More specifically, embodiments disclosed herein relate to using a cuttings storage vessel as a cuttings storage/transfer vessel and as a component in at least one of a tank cleaning system, a slurrification system, and a drilling fluid recycling system.

In other embodiments, cuttings storage vessel assemblies, including two or more cuttings storage vessels, may be operated in cuttings storage/transfer systems and at least one of a tank cleaning system, a slurrification system, and a drilling fluid recycling system. Use of cuttings storage vessels and vessel assemblies in each of these additional systems will be described below. Additionally, modules that may integrate these vessels and vessel assemblies into more than one additional system will also be discussed. Although described with respect to operating cuttings storage vessels and vessel assemblies in additional operations, such as a tank cleaning system, those skilled in the art will appreciate that any vessel located at a drilling location for performing in a specified drilling operation may be integrated into the additional systems and methods disclosed herein.

Figure 3:
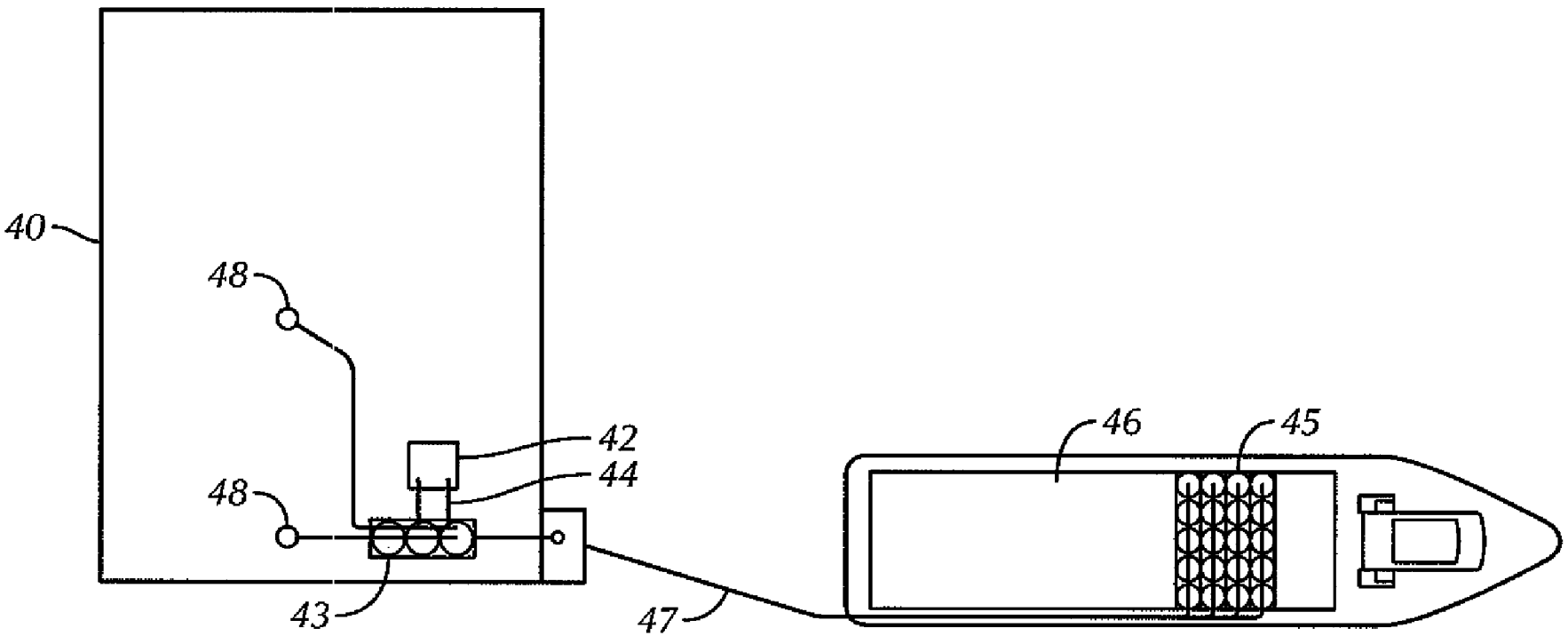
FIG. 3 is a top view of a system illustrating use of cuttings storage vessels in a cuttings storage/transfer system and in a module-based system fluidly connected to the cuttings storage vessels in accordance with an embodiment of the present disclosure.

Referring to FIG. 3, a rig 40, including a system module 42 according to embodiments of the present disclosure, is shown. System module 42 may be located anywhere on rig 40, and in some embodiments is located proximate a set of cuttings storage vessels 43, or a vessel assembly, that may be fluidly connected to system module 42 via connection lines 44. Cuttings storage vessels 43 may be detachably connected to a second set of storage vessels 45 located on a supply boat 46 by a flexible hose 47. System module 42 may include a tank cleaning system module, a slurrification system module, and/or a drilling fluid recycling module, among others.

In operation, cuttings may be transferred to cuttings storage vessels 43 via one or more pneumatic transfer devices 48 located on rig 40. The cuttings may be stored in cuttings storage vessels 43 until they are transferred to supply boat 46 for disposal thereafter.

Cuttings transfer systems, slurrification systems, drilling fluid recycling systems, and tank cleaning systems, as described above, are typically independent systems, where the systems may be located on rig 40 permanently or may be transferred to rig 40 from supply boat 46 when such operations are required. However, in embodiments disclosed herein, system module 42 may be located on rig 40 proximate cuttings storage vessels 43, and transfer lines 44 may be connected therebetween to enable use of the cuttings storage vessels 43 with tanks, pumps, grinding pumps, chemical addition devices, cleaning equipment, water supply tanks, filter systems, and other components that may be used in other operations performed at a drilling location, including tank cleaning operations, drilling fluid recycling, and slurrification of drill cuttings. Such integrated systems may allow for existing single use structures (e.g., cuttings storage vessels 43) to be used in multiple operations (e.g., tank cleaning systems and cuttings storage/transfer). Thus, when not being used to store or transport cuttings, vessels 43 may be operated in a tank cleaning system, a slurrification system, and/or a drilling fluid recycling system.

As described above, previous tank cleaning systems required the conversion of valuable drilling rig space for tank cleaning equipment. However, embodiments described herein allow existing structural elements (i.e., cuttings storage vessels) to be used in multiple operations. System modules 42 may be relatively small compared to previous system modules, thereby preserving valuable rig space, and preventing the need for costly and dangerous lifting operations. Those of ordinary skill in the art will appreciate that the systems of FIGS. 1-3 are exemplary and additional components located at a drilling location may also be used in systems disclosed herein.

Tank Cleaning Systems Using Cuttings Storage Vessels

Figure 4:
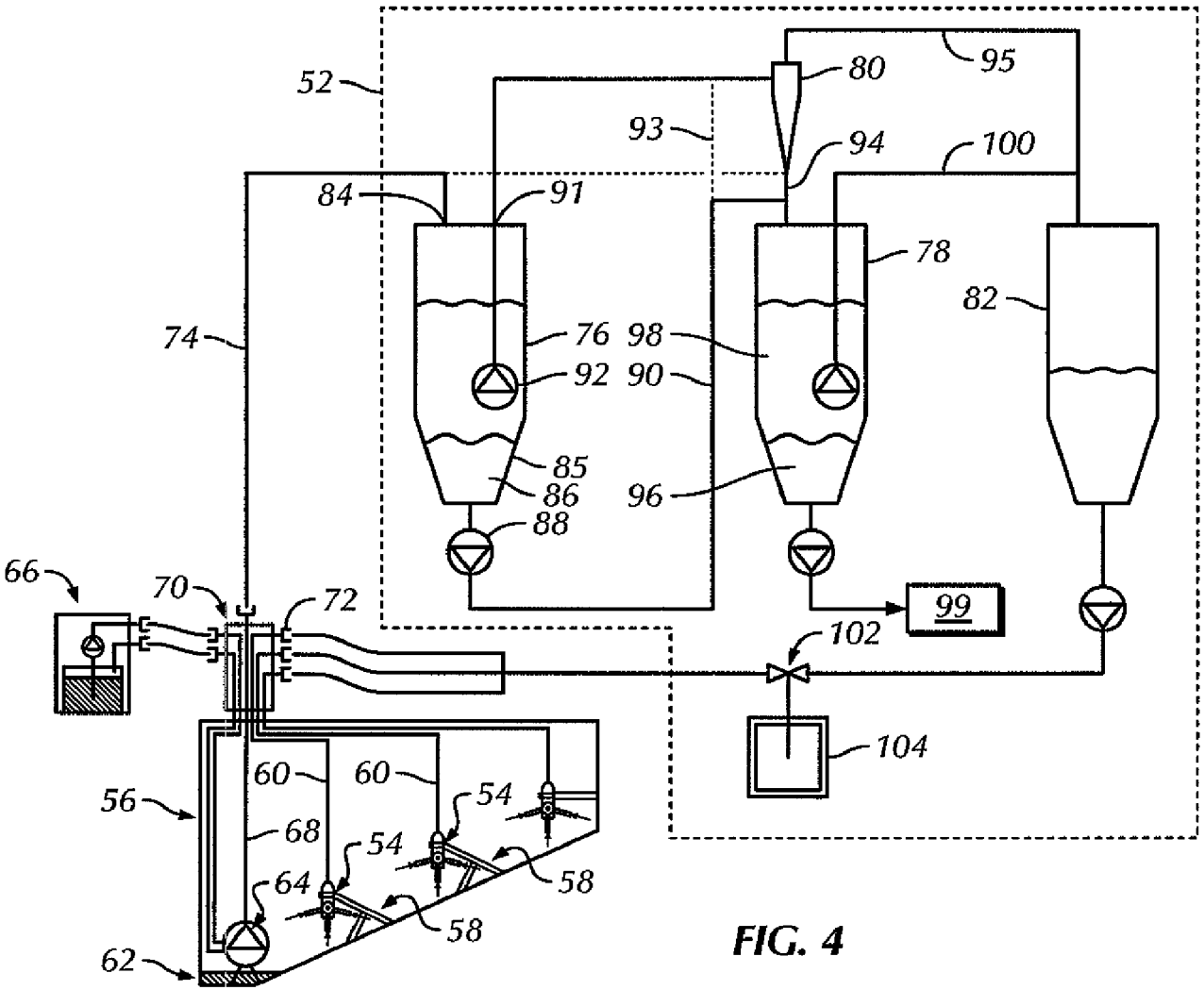
FIG. 4 is a simplified flow diagram of a tank cleaning system according to embodiments disclosed herein.

Referring now to FIG. 4, a tank cleaning system incorporating at least one drill cuttings vessel is illustrated. The tank cleaning system may include a water recycling unit 52 and one or more manual or automated tank cleaning machines, such as rotary jet head washers 54. Rotary jet head washers 54 may be positioned within a mud tank 56, or any other tank being cleaned. Although shown as being fixed in position, these multi-headed or single-headed nozzle rotary jet head washers 54 may be lowered into the tank 56 or otherwise suspended and positioned temporarily or permanently within the tank 56 using brackets 58, stands, penetration through the deck/side of the tank, or the like. The rotary jet head washers 54 may be supplied with pressurized wash fluid by way of the wash fluid lines 60. The rotation of the nozzles might be provided by a pneumatic motor or by a turbine in the cleaning fluid flow. As the wash fluid exits the rotary jet head washers 54, tank 56 is washed with pressurized wash fluid that dislodges any solids or sediment present in tank 56, generating tank slop 62, a combination of solids and wash fluid.

A hydraulic pump 64 may be connected to a hydraulic power unit 66, so that hydraulic pump 64 may sit on the tank slop 62 and pump the combination of solids (such as from drilling or other fluids used on the drilling location that could contaminate the tank) and wash fluid up the tank slop line 68. As shown, the hydraulic pump 64 is lowered into the tank 56 for use in the washing operation; alternatively, the pump 56 may be mounted either temporarily on brackets or permanently mounted in the tank 56. The tank slop line 68 may carry the tank slop 62 directly to the water recycling unit 52 or through a modular fluid distribution manifold 70 designed with control valves (not shown) and hose connections 72, or quick connect hose lines in some embodiments. Tank slop 62 may then be transmitted by way of external slop line 74 to the water recycling unit 52.

Water recycling unit 52 may include a water recovery tank 76, a cuttings box 78, and a filtration system 80. Water recycling unit 52 may also include a clean water tank 82. In some embodiments, one or more of the water recovery tank and the cuttings box may be as described in U.S. Patent Application Publication No. 20050205477. In some embodiments, one or more cuttings storage vessels, as disclosed above, may be integrated into the tank cleaning system and may function as one or more of the water recovery tank 76, the cuttings box 78, and the clean water tank 82.

The tank slop 62 may be pumped into a top portion of the water recovery tank 76 at an inlet 84. The water recovery tank 76 may have a sloped bottom 85 that may be round, square, or rectangular. Solids 86 from the tank slop 62 may settle to the bottom of the water recovery tank 76 and may gather in the sloped bottom 85. The solids 86 that collect at the sloped bottom 85 of the water recovery tank 76 may then be pumped by an auger fed progressive cavity pump 88 to the cuttings box 78 through a line 90. Alternatively, solids 86 may be released from the water recovery tank 76 by a valve and pumped to the cuttings box 78.

The liquid in the water recovery tank 76 may be pumped to one or more filtration systems 80, which may include one or more hydrocyclones, centrifuges, filters, filter presses, and hydrocarbon filters. In some embodiments, the liquid may be transmitted through an outlet 91, such as by a diving pump or submersible pump 92. In other embodiments, a solids-rich fraction and a solids-lean fraction may be sequentially pumped from water recovery tank 76 via pump 88, where the solids-rich fraction may be directed to cuttings box 78, and the dirty water or solids-lean fraction may be transmitted to filtration system 80 through line 93. Other alternative flow schemes may also be used, such as where the settling efficiency is sufficient to develop a clean water fraction in water recovery unit 76.

In a hydrocyclone 80, for example, small solids that did not settle out of the fluid when introduced in the water recovery tank 76 may be removed by the centrifugal force created within the hydrocyclone 80. Solids may be directed by purge flow line 94 from the hydrocyclone 80 to the cuttings box 78. Additionally, the solids may be gravity fed or pumped from the hydrocyclone 80 to the cuttings box 78 or to a disposal vessel. The overflow from the hydrocyclone 80 may be directed through line 95 to the clean water tank in some embodiments, or recycled to directly supply water to the rotary jet head washers 54 in other embodiments.

The cuttings box 78 may be used to further promote the settling of the solids 86 from the slurry. Cuttings box 78 may be any cuttings box normally found onboard drilling rigs, for example, or may be a cuttings storage vessel. Cuttings box 78 may separate the solids 86 into a solids fraction 96 and a solids-lean fraction 98. In some embodiments, an oil fraction (not shown) may also form in cuttings box 78. The solids fraction 96 may be pumped to a disposal vessel 99, for example, a cuttings storage vessel, for later disposal. The solids-lean fraction 98 may be pumped via fluid line 100 to the clean water tank 82 or recycled to directly supply water to the rotary jet head washers 54.

As previously discussed, the cuttings box 78 may be any cuttings box as used onboard a rig and as typically used to transport drill cuttings. Once a first cuttings box 78 is nearly fall with solids 96, a second cuttings box (not individually illustrated) may then replaces the first cuttings box 78. Valves (not shown) may be used to temporarily stop or divert the flow to the cuttings box 78 while it is replaced with a second cuttings box.

Alternatively, a cuttings storage vessel may be integrated into a tank cleaning system and may function as a cuttings box. When a cuttings storage vessel 22 operating as a cuttings box is nearly full with solids and liquids, additional cutting storage vessels, if available, may be used as a cuttings box, separating solids and liquids.

In some embodiments, the clean water recovered from the water recovery tank 76 and the cuttings box 78 may be pumped through flow lines 60 to one or more rotary jet head washers 54 to clean the tank 56. In other embodiments, the clean water recovered from the water recovery tank 76 may be returned to an existing clean water storage vessel (not shown) on the rig. In yet other embodiments, the clean water recovered from the water recovery tank 76 may be stored in a cuttings storage vessel operating as a storage tank for use in the tank cleaning system 52.

To assist the cleaning of tanks 56 using the above described tank cleaning system, it may be desired to use various chemicals, such as cleaning chemicals, in addition to the water provided to rotary jet head washers 54. A wide variety of wash fluids may be used, including detergents, surfactants, anti-foaming agents, suspending agents, lubricating agents (to reduce the wear caused by the flowing solids), and the like, to assist in the quick and efficient cleaning of the tank 56. A chemical inductor 102 may be used to add such cleaning chemicals 104 to the wash water.

As described above, a cuttings storage vessel may be integrated into the cleaning system and may function as one or more of the water recovery tank, the cuttings box, and the clean water tank. In some embodiments, where a cuttings storage vessel functions as a water recovery tank or a cuttings box, more than one outlet may be provided for pumping the solids and liquid fractions. In other embodiments, the solids fraction and liquid fractions may be sequentially transmitted from the cuttings tank to their respective destinations. Sequential transmission may be facilitated by providing a sight glass for an operator to visually determine when the flow has changed from the solids fraction to a solids-lean fraction. Alternatively, measurement of conductance or density may be used to indicate when the flow has changed from the solids fraction to a solids-lean fraction. Upon determination of the flow transition, an operator or automated system may appropriately redirect the flow.

In some embodiments, a settling efficiency of solids within a cuttings storage vessel may eliminate the need for various components of the cleaning system. For example, a cuttings storage vessel may have a larger volume, diameter, or height than current water recovery tanks and cuttings boxes used in tank cleaning systems, such that the flow of tank slop into the cuttings storage vessel may not disturb the settling of solids.

Alternatively, use of a cuttings storage vessel or more than one cuttings storage vessel as a water recovery tank may allow complete or nearly complete settling of solids in one cuttings storage vessel prior to pumping the solids fraction and the solids-lean fraction from the cuttings storage vessel. Where complete or nearly complete settling of solids in a cuttings storage vessel may be achieved, it may be possible, in some embodiments, to eliminate the cuttings box from the tank cleaning system.

Figure 5:
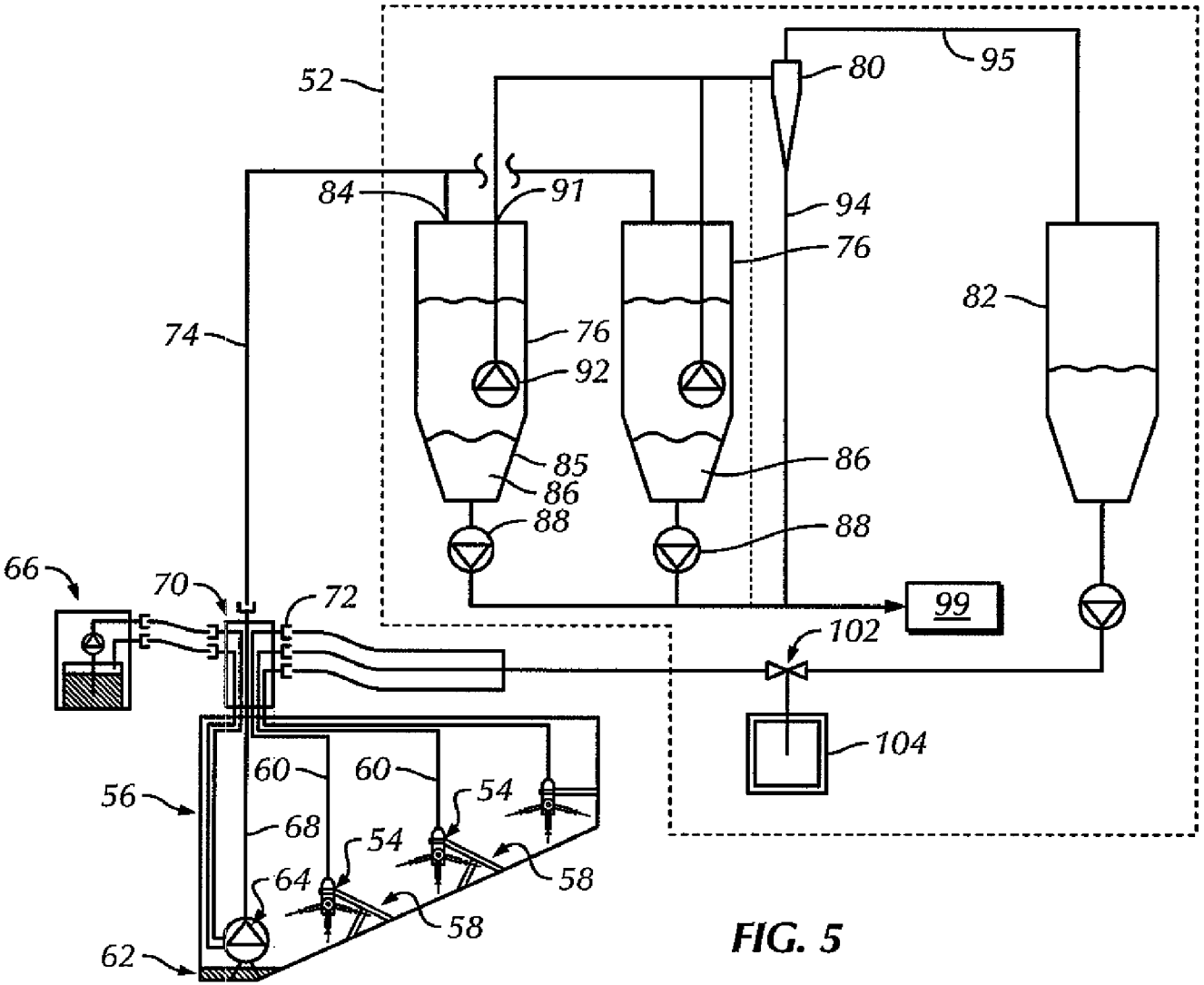
FIG. 5 is a simplified flow diagram of a tank cleaning system according to embodiments disclosed herein.

Referring now to FIG. 5, another embodiment of a tank cleaning system 52 integrating at least one cuttings storage vessel is illustrated, where like numerals represent like components. In this embodiment, adequate liquid-solids separations may be attained in cuttings storage vessel(s) to allow the cuttings box to be excluded from the system. Solids fraction 86 pumped from one or more cuttings storage vessels 76 functioning as a water recovery tank may be mixed in a mixer M and may accumulate in a separate disposal vessel 99 for later disposal. Dirty water may be processed in hydrocyclone 80, separating solids 94 and clean water 95. As above, the solids and solids-lean fractions may be pumped through separate outlets from water recovery tanks 76, or may be sequentially pumped from the sloped bottom 85 of the water recovery tanks 76, where the solids-lean fraction may be transmitted via line 93 to hydrocyclone 80.

In some embodiments, the use of hydrocyclones 80 to remove fine solids from the water may not be necessary for the operation of the tank cleaning system 52 due to the settling that may be attained within a cuttings storage vessel. Efficiency of the system 52 may be reduced when no further separations, such as hydrocyclone 80, are included. Thus, processing of a solids-lean fraction from a cuttings storage vessel through hydrocyclones 80 may be optional in some embodiments; in other embodiments, a cleaning system may not include hydrocyclones.

As illustrated and described with respect to FIGS. 4-5, one or more cuttings storage vessels may be integrated into a tank cleaning system and may function as a water recovery tank, a cuttings box, and/or a clean water storage tank. In some embodiments, the one or more cuttings storage vessels may be integrated into a tank cleaning system using a module. A module may allow for equipment used in the tank cleaning system to be conveniently lifted to the rig when needed and from the rig when cleaning operations have concluded. Depending upon the function of a cuttings storage vessel in the tank cleaning system, the module may include one or more fluid connections that are in fluid communication with an inlet or an outlet of a cuttings storage vessel, or that are in fluid communication with other external components of a tank cleaning system, such as a tank slop pump. Components contained in the module may include the components of the tank cleaning system, as described above with respect to FIGS. 3-4, excluding the vessels that the cuttings storage vessels may be functioning as and/or replacing.

Figure 6:
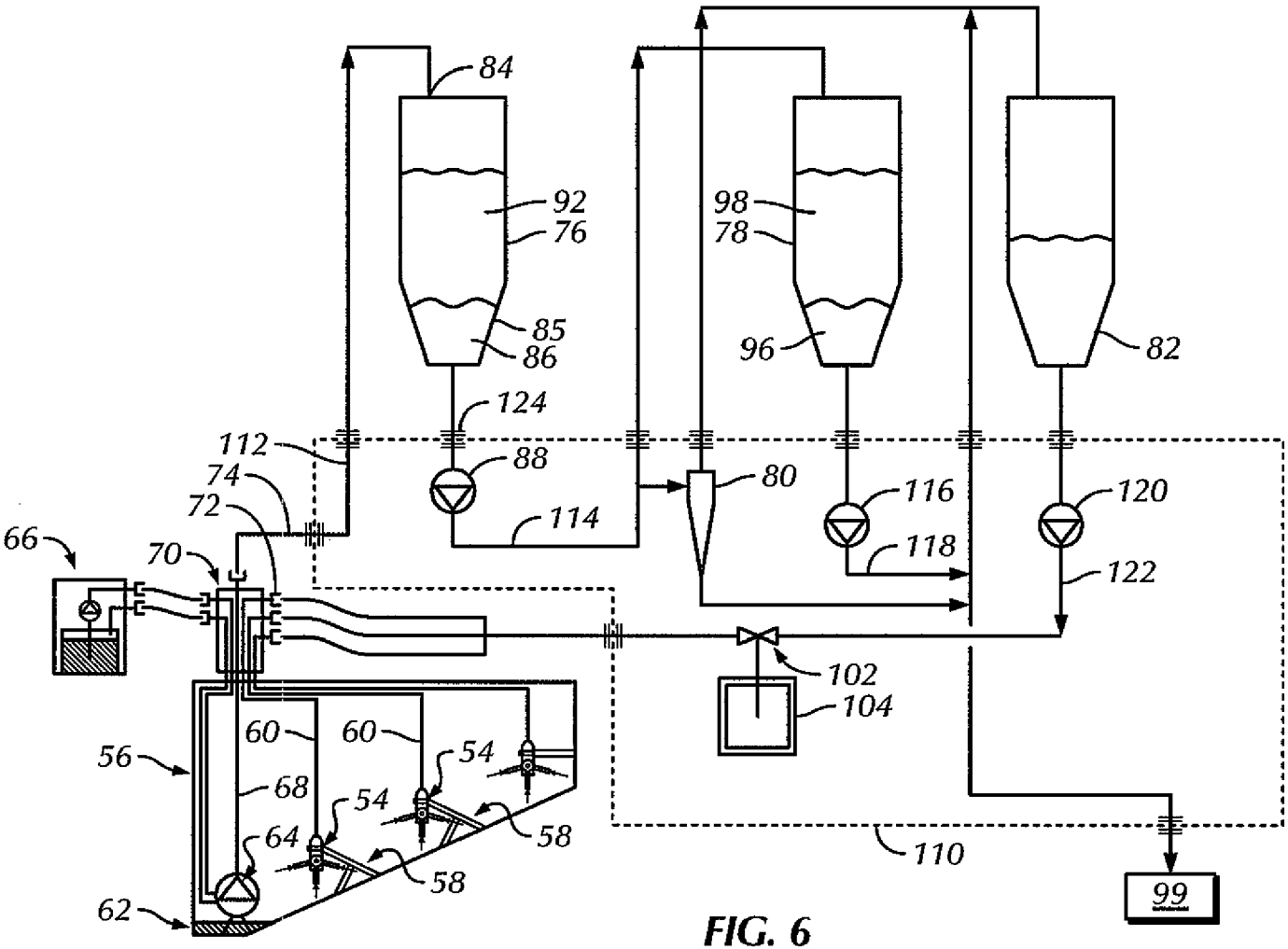
FIG. 6 illustrates a module for converting a cuttings storage/transfer system into a tank cleaning system in accordance with an embodiment of the present disclosure.
Figure 7:
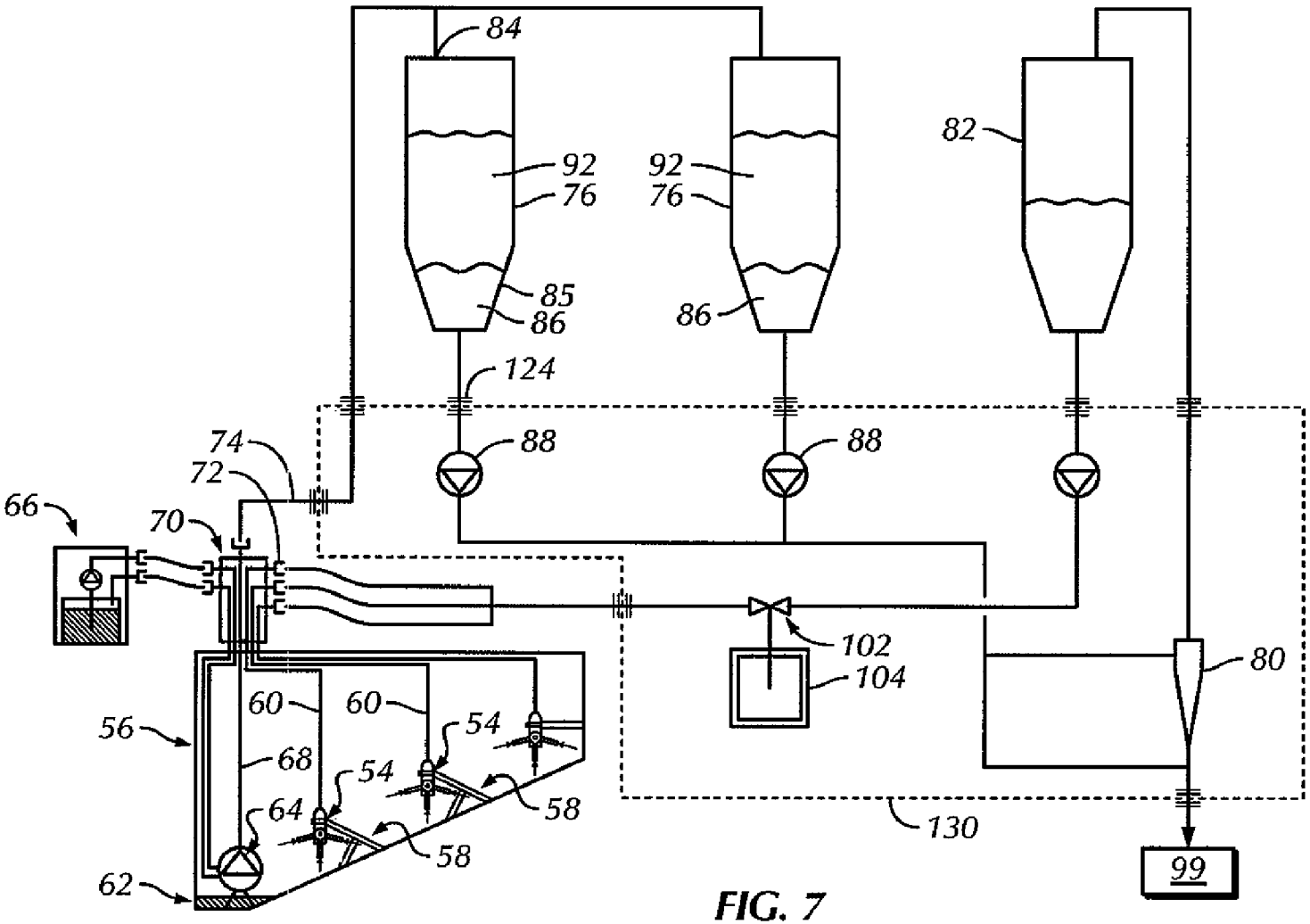
FIG. 7 illustrates another module for converting a cuttings storage/transfer system into a tank cleaning system in accordance with an embodiment of the present disclosure.

As illustrated in FIGS. 6-7, one or more cuttings storage vessels may be integrated into a tank cleaning system using a module, where like numerals represent like parts. As illustrated, the tank cleaning system flow diagrams illustrate modules where materials in the cuttings vessels are pumped sequential from the vessel. One skilled in the art would appreciate that other flow schemes, for example, having a separate pump for the solids-lean fractions, may be included with the modules. One skilled in the art would also appreciate that other equipment not shown on the simplified flow diagrams may also be used, including valves, control valves, power supplies, filters, pressure regulators, and the like.

Referring now to FIG. 6, one embodiment of a module 110 to integrate one or more cuttings storage vessels into a tank cleaning system according to embodiments disclosed herein, is illustrated. As cuttings storage vessels may function as one or more of the water recovery tank 76, the cuttings box 78, and the clean water storage tank 82, the equipment contained in a module may vary. For example, module 110 may provide a fluid communication conduit 112 for transmitting tank slop 62 from line 74 to inlet 84 of vessel 76. Additionally, module 110 may include pumps 88 and conduit 114 for transmitting solids 86 and solid-lean fluids 92 from water recovery tank 76 to filtration system 80 and cuttings box 78. Module 110 may also provide pumps 116 and conduit 118 for transmitting solids 96 and solids-lean fractions 98 from cuttings box 78 to disposal vessel 99 and clean water tank 82, respectively. Further, module 110 may include pumps 120 and conduit 122 for transmitting clean water from water tank 82 to rotary jet head cleaners 54. Where not individually provided on a rig, module 110 may also include a chemical inductor 102 and cleaning chemicals 104.

Connections 124 between conduit within module 110, the integrated cuttings storage vessels, and distribution manifold 70 may be flanged, screwed, or quick-connect connections. Additionally, module 110 may include spooled conduit for attaching to various inlets and outlets of the cuttings storage vessels, disposal vessels 99, and manifold 70. Spooled conduit may be useful for attaching to inlets and outlets remote from the location where the module is located on the rig.

Referring now to FIG. 7, another embodiment of a module to integrate cuttings storage vessels into a tank cleaning system, according to embodiments disclosed herein, is illustrated. One or more cuttings storage vessels may be integrated into a tank cleaning system using a module 130, where the cuttings storage vessels are used in parallel as water recovery tanks 76, similar to FIG. 5, without a cuttings box. Similar to module 110, module 130 may provide for pumps and fluid communication between flow manifold 70, vessels 76, 82, 99, hydrocyclone 80 (when used), and chemical inductor 102 and cleaning chemicals 104.

The modules described above with respect to FIGS. 5-6 may additionally include programmable logic controllers, digital control system connections, chemical inductor(s) and cleaning chemical tank(s), power connections, among other equipment and lines. For example, a control system may be provided to locally or remotely operate the tank cleaning system.

Other module systems for integrating cuttings storage vessels into a tank cleaning system may be envisaged. The modules described above with respect to FIGS. 5-6 may include or exclude various components due to the existing lines and equipment located on the rig, and the type and number of cuttings storage vessels integrated into a tank cleaning system. For example, FIGS. 5-6 illustrate integration of three cuttings storage vessels, whereas additional or fewer cuttings storage vessels may be integrated, requiring fewer or additional components to be included in the module.

In some embodiments, ISO-PUMPS may be used as cuttings storage vessels integrated into the tank cleaning system. ISO-PUMPS may be used to transfer cuttings and fluids between vessels without the need for a pump 88, for example. Where ISO-PUMPS may provide for transmitting fluids and solids between vessels, the equipment required for modules 110, 130 may be further minimized.

As mentioned above, where cuttings storage vessels may provide for adequate separation of the liquids and solids fractions, hydrocyclone 80 may not be a necessary component. Thus, in some embodiments, hydrocyclone 80 and related equipment and lines may not be included in module 110, 130.

Additionally, existing lines may be provided for fluid communication between the cuttings storage vessels integrated into the cuttings storage system using a module 110, 130. For example, a cuttings storage system may provide for communication between one cuttings storage vessel outlet and an inlet of a second cuttings storage vessel. Additionally, a cuttings storage system may provide for common inlet and/or common outlet lines. Module 110, 130 may advantageously connect to these common lines, simplifying and/or minimizing the lines and equipment needed to integrate the cuttings storage vessels into a tank cleaning system.

Use of Cuttings Storage Vessels in a Slurrification System

Integration of a cuttings storage vessel into a slurrification system is now described with respect to cuttings storage vessel(s) disposed on a rig. One of ordinary skill in the art, however, will appreciate that the cuttings storage vessels may be disposed at any work site, including a rig, a transport vehicle, a supply boat, or other treatment facility, without departing from the scope of embodiments disclosed herein. In this embodiment a module may be disposed at the work site proximate the cuttings storage vessel and operatively connected to the cuttings storage vessel, thereby converting the cuttings storage vessel from a vessel for storing cuttings to a component of a slurrification system.

As described above, previous fluid slurrification systems required the conversion of valuable drilling rig space (or deck space for boats and other transport vehicles) for storing independent fluid recovery vessels and processing equipment. However, embodiments disclosed herein allow existing structural elements (i.e., cuttings storage vessels 202) to be used in multiple operations. Modules in accordance with embodiments disclosed herein are relatively small compared to previous systems, thereby preserving valuable drill space, and preventing the need for costly and dangerous lifting operations.

Figure 8:
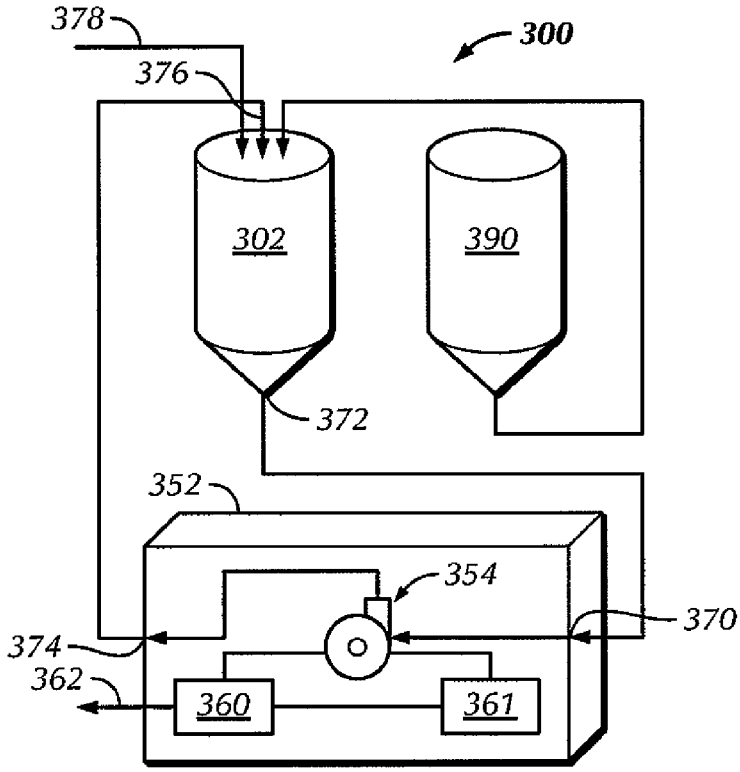
FIG. 8 shows a slurrification system in accordance with embodiments of the present disclosure.

Referring now to FIG. 8, a slurrification system 300 incorporating a first cuttings storage vessel 302 is illustrated. Slurrification system 300 includes a module 352, or drive unit, configured to operatively connect with the first cuttings storage vessel 302, and a fluid supply line 378. Module 352 may include a containment unit, a skid, a housing, or a moveable platform configured to house select slurrification system components, as described in more detail below.

In this embodiment, system 300 includes an independent power source 360 for providing power to components of module 352. Power source 360 is electrically connected to, for example, grinding device 354 and/or a programmable logic controller (PLC) 361. Those of ordinary skill in the art will appreciate that such a power source may provide primary or auxiliary power for powering components of module 352. In other embodiments, power source 360 may be merely an electrical conduit for connecting a power source on a rig (not shown) via an electrical cable 362, to module 352.

Module 352 includes an inlet connection 370 configured to connect with outlet 372 of first cuttings storage vessel 302, and an outlet connection 374 configured to connect with an inlet 376 of first cuttings storage vessel 302. Inlet connection 370 may be connected to outlet 372 and outlet connection 374 may be connected to inlet 376 by fluid transfer lines, for example, flexible hoses and/or new or existing piping. Module 352 further includes a grinding device 354 configured to facilitate the transfer of fluids from the first cuttings storage vessel 302, through the module 352, and back to the first cuttings storage vessel 302. Grinding device 354 is configured to reduce the particle size of solid materials of the drill cuttings transferred therethrough.

Figure 9:
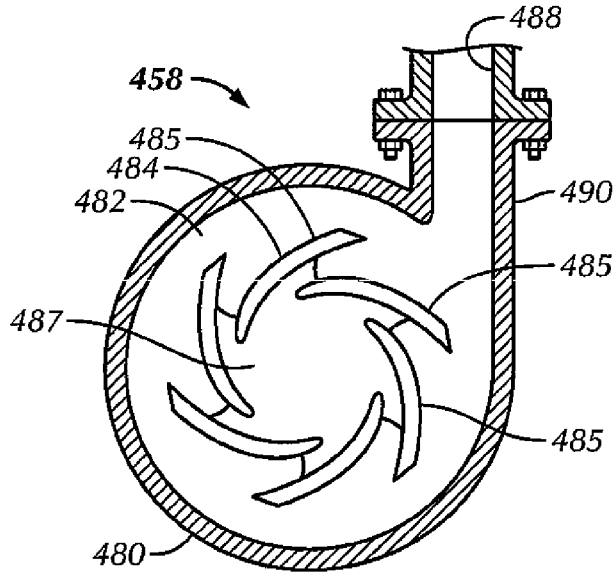
FIG. 9 shows a grinding device in accordance with embodiments of the present disclosure.

In one embodiment, grinding device 354 may include a grinding pump. The grinding pump may be, for example, a centrifugal pump, as disclosed in U.S. Pat. No. 5,129,469, and incorporated by reference herein. As shown in FIG. 9, a centrifugal pump 458, configured to grind or reduce the particle size of drill cuttings, may have a generally cylindrical casing 480 with an interior impeller space 482 formed therein. Centrifugal pump 458 may include an impeller 484 with backward swept blades with an open face on both sides, that is, the blades or vanes 485 are swept backward with respect to a direction of rotation of the impeller and are not provided with opposed side plates forming a closed channel between the impeller fluid inlet area 487 and the blade tips. The casing 480 has a tangential discharge passage 488 formed by a casing portion 490. The concentric casing of centrifugal pump 458 and the configuration of the impeller blades 485 provide a shearing action that reduces the particle size of drill cuttings. The blades 485 of the impeller 484 may be coated with a material, for example, tungsten carbide, to reduce wear of the blades 485. One of ordinary skill in the art will appreciate that any grinding pump known in the art for reducing the size of solids in a slurry may be used without departing from the scope of embodiments disclosed herein.

Figure 10:
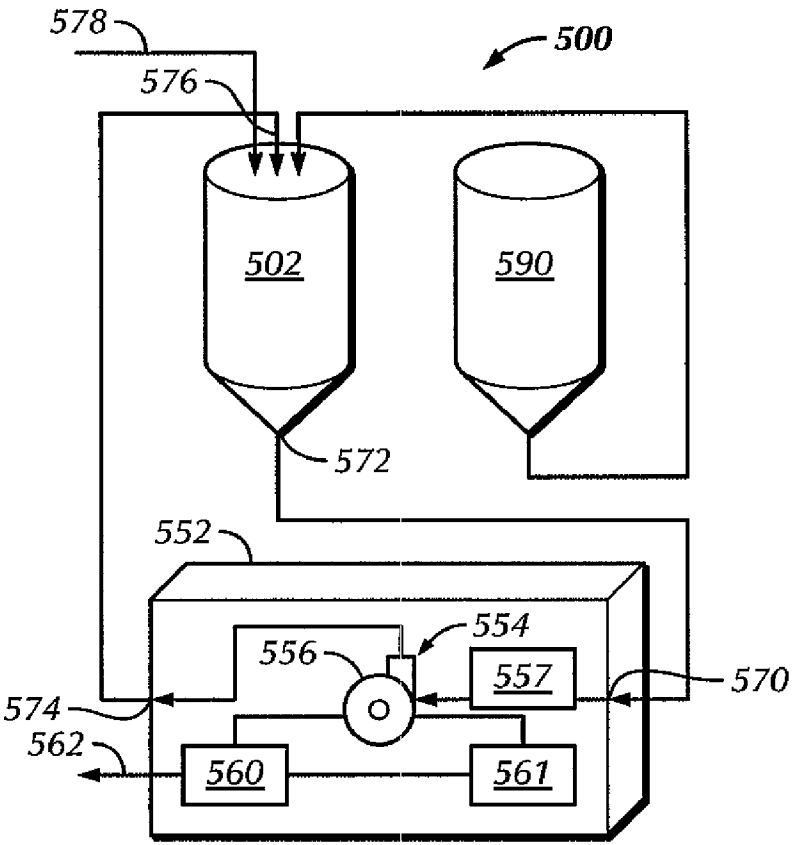
FIG. 10 shows a slurrification system in accordance with embodiments of the present disclosure.

In an alternative embodiment, as shown in FIG. 10, grinding device 554 may include a pump 556 and a grinder 557, for example, a ball mill. In this embodiment, cuttings may be injected into the grinder 557, wherein the particle size of the solids is reduced. The pump 556 may then pump the slurry back to first cuttings vessel 502. In one embodiment, the pump may include a grinding pump, as disclosed above, as a second grinder, for further reduction of the particle size of solids exiting the grinder 557.

Referring back to FIG. 8, in one embodiment, slurrification system 300 further includes a second cuttings storage vessel 390. Second cuttings storage vessel 390 may be configured to supply cuttings to first cuttings storage vessel 302. In one embodiment, a pump (not shown), as known in the art, may be used to transfer the cuttings. In another embodiment, a pneumatic transfer device (not shown), as disclosed above, may be used to transfer the cuttings to the first cuttings storage vessel 302. One of ordinary skill in the art will appreciate that any method for transferring the cuttings to first storage vessel 302 may be used without departing from the scope of embodiments disclosed herein.

In one embodiment, module 352 may further include a pneumatic control device (not shown) to control the flowrate of air injected into the cuttings storage vessel 302 by a pneumatic transfer device (not shown). In such an embodiment, an air line (not shown) from an air compressor (not shown) may be coupled to the pneumatic control device (not shown) in module 352 to control a flow of air into first cuttings storage vessel 302.

In another embodiment, cuttings may be supplied to first cuttings storage vessel 302 from a classifying shaker (not shown) or other cuttings separation or cleaning systems disposed on the drilling rig. Additionally, multiple cuttings storage vessels may be connected to and supply cuttings to first cuttings storage vessel 302. In one embodiment, each cuttings storage vessel may be configured to supply cuttings of predetermined sizes, for example, coarse cuttings or fines. Cuttings of a selected size may then be provided to first cuttings storage vessel 302 to form a slurry of a predetermined density. One of ordinary skill in the art will appreciate that the cuttings may be transferred to the first cuttings storage vessel 302 by any means known in the art, for example, by a pump or a pneumatic transfer device, as described above.

During operation of slurrification system 300, fluid supply line 378 may be configured to supply a fluid to first cuttings storage vessel 302. One of ordinary skill in the art will appreciate that the fluid supply line 378 may supply water, sea water, a brine solution, chemical additives, or other fluids known in the art for preparing a slurry of drill cuttings. As the fluid is pumped into first cuttings storage vessel 302, cuttings from the second cuttings storage vessel 390, or other components of the rig's cuttings separation system, as described above, may be transferred into first cuttings storage vessel 302.

As first cuttings storage vessel 302 fills with fluid and cuttings, the mixture of fluid and cuttings is transferred to module 352 through the inlet connection 370 of the module 352. In one embodiment, the mixture may be transferred by a pneumatic transfer device, a vacuum system, a pump, or any other means known in the art. In one embodiment, the pneumatic transfer device may include a forced flow pneumatic transfer system. The mixture of fluid and cuttings is pumped through grinding device 354, wherein the cuttings are reduced in size. The mixture, or slurry, is then pumped back to first cuttings storage vessel 302 via outlet connection 374. The slurry may cycle back through module 352 one or more times as needed to produce a slurry of a predetermined density or concentration of cuttings as required for the particular application or re-injection formation.

Figure 11:
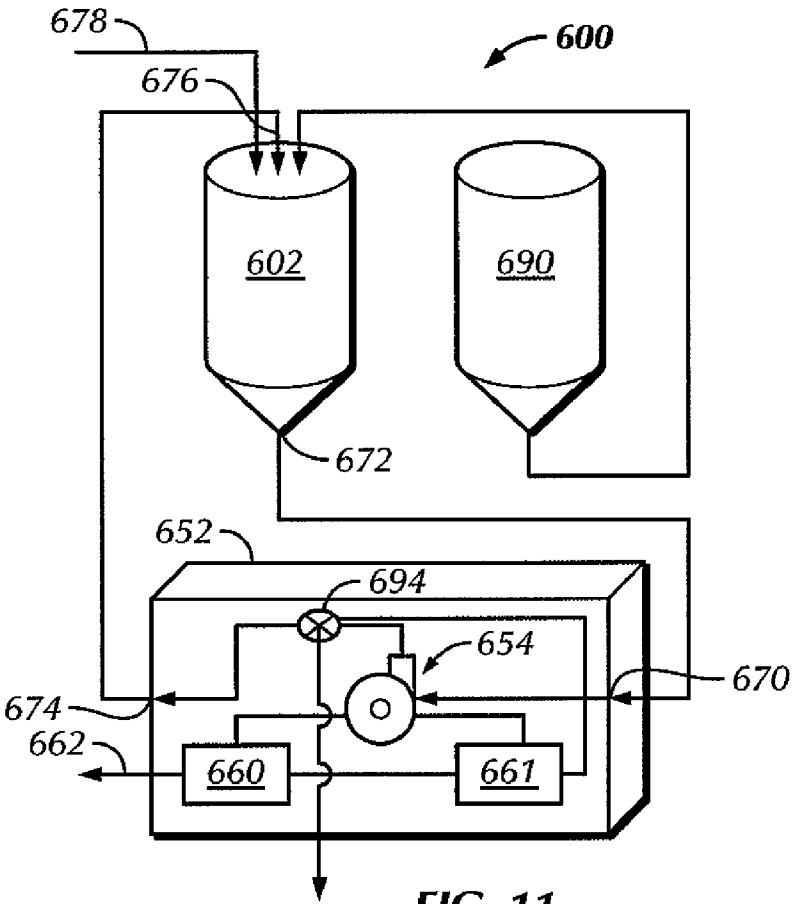
FIG. 11 shows a slurrification system in accordance with embodiments of the present disclosure.

Referring now to FIG. 11, in one embodiment, module 652 further includes a valve 694 disposed downstream of grinding device 654, wherein valve 694 is configured to redirect the flow of the slurry exiting the grinding device 654. In one embodiment, a PLC 661 may be operatively coupled to module 652 and configured to close or open the valve 694, thereby redirecting the flow of the slurry. In one embodiment, the PLC 695 may control the valve 694 to move after a pre-determined amount of time of fluid transfer through module 652. In another embodiment, a sensor (not shown) may be operatively coupled to the valve 694 to open or close the valve when a pre-determined condition of the slurry is met, such as in response to a measurement of density or viscosity of the slurry. For example, in one embodiment, a density sensor (not shown) may be coupled to valve 694, such that, when the density of the slurry exiting grinding device 654 reaches a pre-determined value, valve 694 moves, i.e., opens or closes, and redirects the flow of the slurry from the first cuttings storage vessel 302 to another cuttings storage vessel, a slurry tank, a skip, or injection pump for injection into a formation.

In another embodiment, a conductivity sensor (not shown) may be coupled to valve 694, such that, when the viscosity or density of the slurry exiting grinding device 654 reaches a predetermined value, valve 694 moves and redirects the flow of the slurry from the first cuttings storage vessel 302 to another cuttings storage vessel, a slurry tank, a skip, or injection pump for injection into a formation. One of ordinary skill in the art will appreciate that other apparatus and methods may be used to redirect the flow of the slurry once a predetermined concentration of cuttings in suspension, density, or conductivity has been met. Commonly, a slurry with a concentration of up to 20% cuttings in suspension is used for re-injection into a formation. However, those of ordinary skill in the art will appreciate that direct injection of slurry, using embodiments of the present disclosure, may provide for an increased concentration of cuttings in the slurry.

A slurry formed by a slurrification system, as described above, may be transferred to another cuttings storage vessel, a slurry tank, a skip, or directly injected into a formation. Slurry that is transferred to a tank, vessel, skip, or other storage device, may be transferred off-site to another work site. In one embodiment, the storage device may be lifted off of a rig by a crane and transferred to a boat. Alternatively, slurry may be transferred from the storage device to a slurry tank disposed on the boat.

In one embodiment, the slurry may be transported from one work site to another work site for re-injection. For example, the slurry may be transported from an offshore rig to another offshore rig. Additionally, the slurry may be transported from an offshore rig to an on-land work site. Further the slurry may be transported from an on-land work site to an offshore work site. In other embodiments, the slurry may be produced on a supply boat and transferred to an offshore rig or to a land facility.

Those of ordinary skill in the art will appreciate that the components of systems 300, 500, and 600 may be interchanged, interconnected, and otherwise assembled in a slurrification system. As such, to address the specific requirements of a drilling operation, in particular, for cuttings re-injection, the components of the systems and modules disclosed herein may provide for an interchangeable and adaptable system for slurrification at a drilling location.

Figure 12:
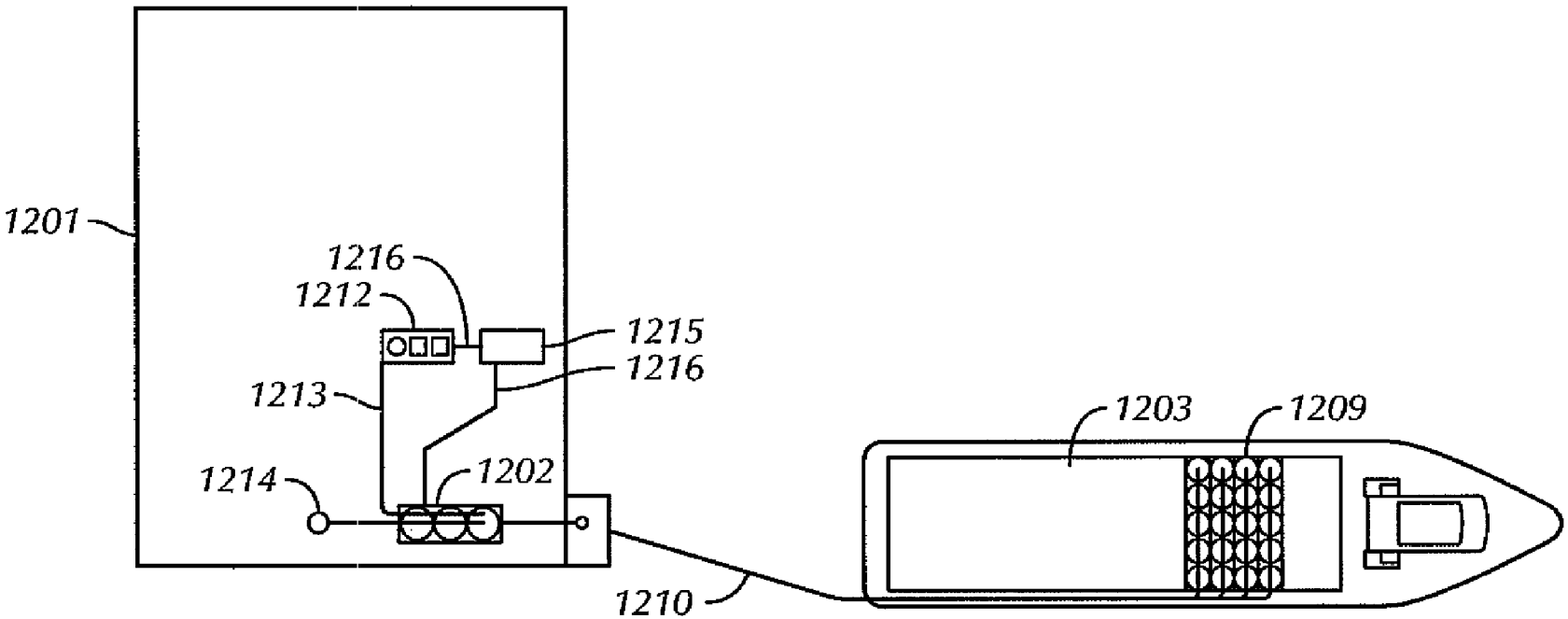
FIG. 12 shows a top view of a system for recycling drilling fluid according to one embodiment of the present disclosure.

Use of Cuttings Storage Vessels in a Drilling Fluid Recycling System or an Environmental Unit Referring to FIG. 12, a rig 1201 including a drilling fluid recycling module 1212 in accord with one embodiment of the present disclosure is shown. In this embodiment, rig 1201 includes a set of cuttings storage vessels 1202 fluidly connected to recycling module 1212 via a connection line 1213. Cutting storage vessels 1202 are detachably connected to a second set of storage vessels 1209 located on a supply boat 1203 by a flexible hose 1210.

In operation, dry cuttings may be transferred to cuttings storage vessels 202 from a pneumatic transfer device 1214 located on rig 1201. Pneumatic transfer device 1214 may include, for example, a mass flow pneumatic transfer system, a vacuum assist transfer system, a cuttings blower, or an ISO-PUMP, as described above. The dry cuttings may be stored in cuttings storage vessel 1202 until they are transferred to supply boat 1203 for transport or disposal thereafter. Typically, during cleaning of the drill cuttings, upstream cleaning devices (e.g., vibratory shakers) generate both dry cuttings and fluids. While the cuttings may be transferred to cuttings storage vessels 1202, the fluids are collected in a drilling fluid reservoir 1215. Examples of reservoirs may include storage tanks, pits, and collection vats, and those of ordinary skill in the art will appreciate that such reservoirs already exist as part of the rig 1201 infrastructure.

In one embodiment, fluid reservoir 1215 is fluidly connected to fluid recycling module 1212 and/or cuttings storage vessels 1202 via transfer lines 1216. Transfer lines 1216 may include flexible hosing and/or preexisting fluid communication lines used to transfer drilling fluid between operations on rig 1201. As described above, drilling fluids are typically cleaned and recycled in independent systems located on rig 1201 either permanently or transferred to rig 1201 from supply boat 1203, when such operations are required. However, in this embodiment, fluid recycling module 1212 is located on rig 1201 proximate cuttings storage vessels 1202, and transfer lines 1213 and 1216 are connected therebetween to integrate the cuttings storage vessels 1202 and module 1212 with preexisting fluid reservoirs 1215. Such an integrated system allows for existing single-use structures (e.g., cuttings storage vessels 1202) to be used in multiple operations (e.g., fluid recycling systems). Thus, in this embodiment, used drilling fluid collected either from the wellbore or from upstream cleaning operations may be pumped from drilling reservoir 1215 to cuttings storage vessels 1202 for cleaning and/or recycling.

As described above, previous fluid cleaning and recycling methods required the conversion of valuable drilling rig space for storing independent fluid recovery vessels and processing equipment. However, embodiments disclosed herein allow existing structural elements (i.e., cuttings storage vessels 1202 and fluid reservoirs 1215) to be used in multiple operations. Fluid recycling module 1212 is relatively small compared to previous systems, thereby preserving valuable drill space, and preventing the need for costly and dangerous lifting operations. Those of ordinary skill in the art will appreciate that the system, as illustrated in FIG. 12, is only exemplary, and alternate systems incorporating additional fluid cleaning components may also be use in drilling fluid recycling systems disclosed herein. Illustrative examples of such systems are described in greater detail below.

Figure 13:
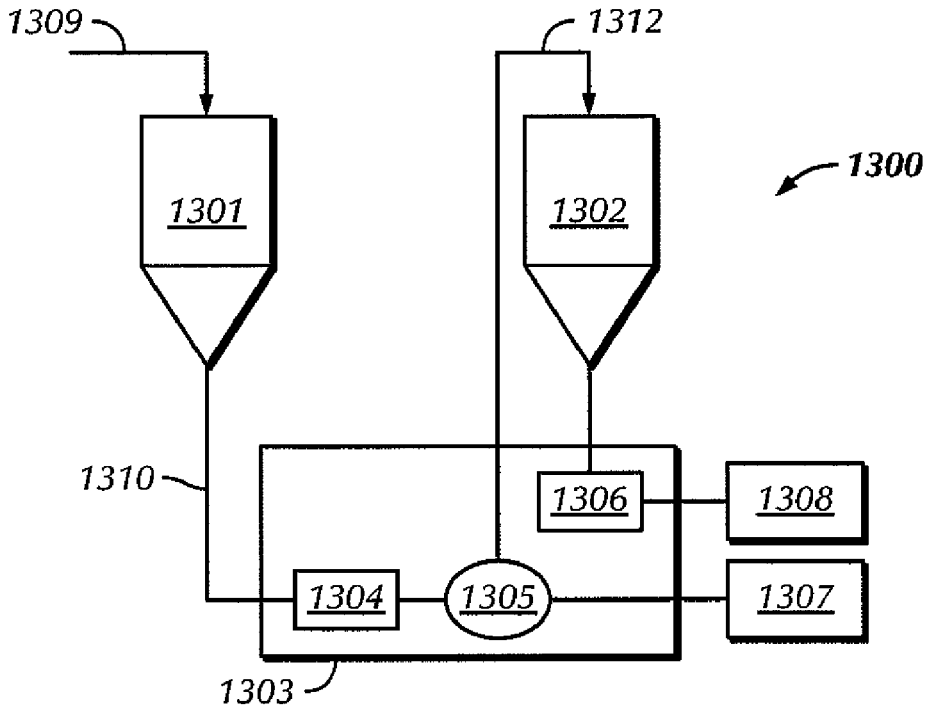
FIGS. 13-16 show systems for recycling drilling fluid according to embodiments of the present disclosure.

Referring to FIG. 13, a system 1300 for recycling drilling fluid according to one embodiment of the present disclosure is shown. In this embodiment, system 1300 includes a first cuttings storage vessel 1301, a second cuttings storage vessel 1302, and a module 1303. Module 1303 includes a pump 1304, a valve 1305, and a filter system 1306. Valve 1305 provides fluid communication between first cuttings storage vessel 1301 and second cuttings storage vessel 1302 and/or a drilling waste or recyclable mud reservoir 1307. Drilling waste or recyclable mud reservoir 1307 may be an existing structural element of a drilling rig, such as a mud pit or collection tank, or in alternate embodiments, may be a component of module 1303. Second cuttings storage vessel 1302 is fluidly connected to filter system 1306, and filter system 1306 is fluidly connected to a cleaned fluids reservoir 1308. Cleaned fluids reservoir 1308 may be an existing structural element of a drilling rig, or in alternate embodiments, may be a component of module 1303. In certain embodiments, those of ordinary skill in the art will appreciate that either drilling waste or recyclable mud reservoir 1307 or cleaned fluids reservoir 1308 may also include cuttings storage vessels 1302.

During operation, used or contaminated drilling fluid, including drill cuttings, particulate matter, suspended materials, chemicals used during the drilling operation, and other materials commonly associated with used or contaminated drilling fluid is pumped into first cuttings storage vessel 1301 via supply line 1309. Other fluids treated according to various embodiments disclosed herein may include fluids from various cleaning operations, such as deck/pit cleaning, as may be stored in a slop tank or received from an automatic tank system, as described herein and in U.S. Provisional Patent Application Ser. No. 60/887,509. The used or contaminated drilling fluid may be mixed with water in first cuttings storage vessel 1301, or pumped into first cuttings vessel 1301 without the addition of water and/or other additives. The mixture in first storage vessel 1301 may be agitated by mechanical means (e.g., an agitator) or otherwise agitated via the addition of liquids (e.g., additional water) to the mixture. After solid particles have settled to the bottom of first cuttings storage vessel 1301, the solid particles of the mixture are pumped out of first cuttings storage vessel 1301 by pump 1304 through outlet line 1310. The extracted mixture may contain both a liquid component and a solid component. Those of ordinary skill in the art will appreciate that due to the separation of solid particles from the used drilling fluid in first cuttings storage vessel 1301, the mixture may initially include a higher concentration of solids component than liquid component. The mixture is pumped through valve 1305, which, as illustrated, allows for the direction of the pumped mixture to be selected between second cuttings storage vessel 1302 and drilling waste or recyclable mud reservoir 1307.

Initially, the pumped mixture may contain a greater percentage of solids content due to the separation, as describe above. A desirable percentage of solid to liquid content may vary according to specific drilling operation requirements; however, those of ordinary skill the art will appreciate that in at least one embodiment, a desirable initial solid content of the pumped mixture may be greater than 50% by volume. As such, the pumped mixture including a desirable solid to liquid ratio for transfer to drilling waste or recyclable mud reservoir 1307 will be hereinafter referred to as a positive mixture. In contrast, a pumped mixture including an undesirable solid to liquid ratio for transfer to drilling waste or recyclable mud reservoir 1307 will be referred to as a negative mixture. Those of ordinary skill in the art will appreciate that in certain embodiments, to recycle drilling fluids efficiently, an acceptable positive condition may be 30% by volume solids, 50% by volume solids, 75% by volume solids, or any volume of solids as determined by a drilling operator. Likewise, acceptable negative conditions, wherein the mixture is pumped to second cuttings storage vessel 1302, may be appropriate when the mixture is 70% by volume liquid, 50% by volume liquid, 30% by volume liquid, or any volume as determined by a drilling operator to achieve a desired level of recycling efficiency.

As the pumped mixture is transferred through outlet line 1310, valve 1305 is actuated to provide fluid communication between first cuttings storage vessel 1301 and drilling waste or recyclable mud reservoir 1307. The positive mixture may continue to be pumped to drilling waste or recyclable mud reservoir 1307 until a negative mixture condition exists. Such a condition may occur when substantially all of the separated solids content from the mixture in first cuttings storage vessel 1301 is extracted.

To determine when such a condition exists, in one embodiment of the present disclosure, outlet line 1310 may be sufficiently translucent to allow a drilling operator to visually inspect and thereby determine an approximate solid to liquid ratio of the pumped mixture. Such visual inspection may rely on properties of the mixture such as color, viscosity, and flow rate. Upon determination of a negative condition, the drilling operator may either manually, or using automated assist means, actuate valve 1305 to change the direction of flow of the pumped mixture between first cuttings storage vessel 1301 and drilling waste or recyclable mud reservoir 1307 to second cuttings storage vessel 1302.

Valve 1305 may be fluidly connected to second cuttings storage vessel 1302 via any of the connection means discussed above, including, for example, flexible hoses and/or existing piping. As valve 1305 is actuated to allow mixture from first cutting storage vessel 1301 to transfer to second cuttings storage vessel 1302, additional fluids, including water and/or chemical may be added to the mixture. Addition of such fluids may occur either during transfer of the mixture through line 1312 (i.e., inline), or after the mixture reaches second cuttings storage vessel 1302. In another embodiment, additional fluids may already exist in second cuttings storage vessel 1302 when the mixture is pumped thereto.

The mixture in second cuttings storage vessel 1302 may be allowed to separate and/or further settle, or otherwise agitated using mechanical agitators (i.e., stirrers) or an inflow of fluids, as described above. Those of ordinary skill in the art will appreciate that the level of agitation, if agitation is used, will vary based on the specific properties of the mixture at the time such mixture is transferred to second storage vessel 1302. In at least one embodiment, such as in an embodiment using existing ISO-PUMPS, those of ordinary skill in the art will appreciate that no mechanical agitation means is used.

After sufficient separation of the mixture in second cuttings storage vessel 1302, the solution is transferred to filter system 1306. Filter system 1306 may include a number of different filters including, for example, hydrocarbon filters and filter presses, depending on the specific properties of the drilling fluid being processed. Those of ordinary skill in the art will appreciate that fluids containing substantially low levels of hydrocarbon content may merely be filtered through a hydrocarbon filter, while dense fluids including large amounts of solid matter may be filtered through a filter press, centrifuge, or other filter means. Upon completion of filtration, the cleaned fluid is transferred to cleaned fluid reservoir 1308. In certain embodiments, uncleaned fluid, including solids particulate matter or fluid containing high hydrocarbon levels may either be trapped in filter system 1306, transferred to drilling waste reservoir (not shown), or recycled to either first cuttings storage vessel 1301 or second cuttings storage vessel 1302 for further processing. Thus, in at least one embodiment, a cleaning loop may exist allowing for the substantially continuous processing of drilling fluids. In such a loop, cleaned fluids may be collected in a cleaned fluids reservoir 1308 for reuse in the drilling operation, while waste products may be separated and collected in the drilling waste or recyclable mud reservoir 1307 for disposal or further remediation.

Figure 14:
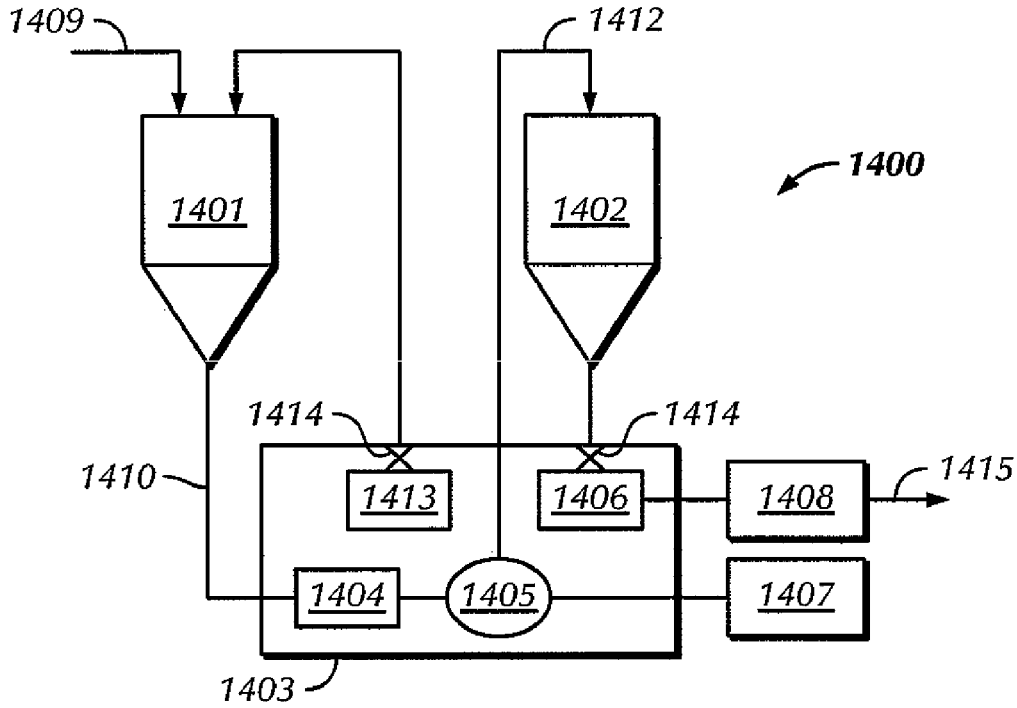

Referring to FIG. 14, a system 1400 for recycling drilling fluid in accordance with one embodiment of the present disclosure is shown. In this embodiment, system 1400 includes a first cuttings storage vessel 1401, a second cuttings storage vessel 1402, and a module 1403. Module 1403 includes a pump 1404, a valve 1405, a dosing tank 1413, a filter system 1406, and a plurality of control valves 1414. Valve 1405 provides for the control of fluid communication between first cuttings storage vessel 1401 and second cuttings vessel 1402 and/or drilling waste reservoir 1407. As described above, all structural elements including drilling waste reservoir 1407 and supply lines may be existing structures at a drilling location.

In this embodiment, drilling fluid is pumped or otherwise communicated from an upstream cleaning process into first cuttings storage vessel 1401 via a supply line 1409. In first cuttings storage vessel 1401, drilling fluid is mixed with additional water, as described above, or chemical additives to facilitate the precipitation and/or settling of solids particulates and material suspended within the drilling fluid. The additives and/or water may be added from dosing tank 1413, wherein such additives are mixed, stored, and/or added to first cuttings storage tank 1401 via, for example, an inline pump (not shown). As illustrated, the communication of additives from dosing tank 1413 to first cuttings storage tank 1401 is controlled by a control valve 1414, which may be, for example, a manual valve or an automated valve, and may be controlled through manual actuation or according to batch sequencing, as will be discussed in detail below.

The water and/or chemical additives added to the drilling fluid in first cuttings storage vessel 1401 may thereby promote the settling of solid material from the drilling fluid. When a desirable quantity of solid matter has separated to require a recycling operation, the settled positive mixture is pumped via pump 1404 through outlet line 1410 to primary valve 1405. As described above, primary valve 1405 controls the flow of the mixture between second cuttings storage vessel 1402 and drilling waste reservoir 1407. In certain embodiments, drilling waste reservoir 1407 may be substituted with a direct feed back to an upstream cleaning operation (e.g., to vibratory shakers) for additional cleaning.

When the mixture reaches a negative condition, primary valve 1405 directs the flow of the mixture to second cuttings storage vessel 1402 via line 1412. The mixture inside second cuttings storage vessel 1402 may be allowed to settle and/or separate further. Such separation may be facilitated by addition of chemicals, water, or agitation, as described above.

After such separation occurs, the mixture is pumped and/or allowed to drain into filter system 1406. Filter system 1406 may include any of the types of filters described above, such as hydrocarbon filters and filter presses, for further removing hydrocarbons and/or solid particulate matter from the mixture. Upon completion of the filtration process, the cleaned fluid is directed to cleaned fluid reservoir 1408, and the remaining impurities (e.g., hydrocarbons and solid matter) may be trapped in filter system 1406, directed to drilling waste reservoir 1407, or otherwise collected for eventual disposal and/or further remediation. In this embodiment, cleaned fluid reservoir 1408 includes an outlet line 1415, which may be used to transfer the cleaned fluids to other operations on the rig. Such operations may include directing the cleaned fluids for use in drilling fluid mixing vessels, fluids used in the slurrification of cuttings for re-injection, fluids used for cleaning operations, or for other operations which require cleaned fluids at a drilling location.

Figure 15:
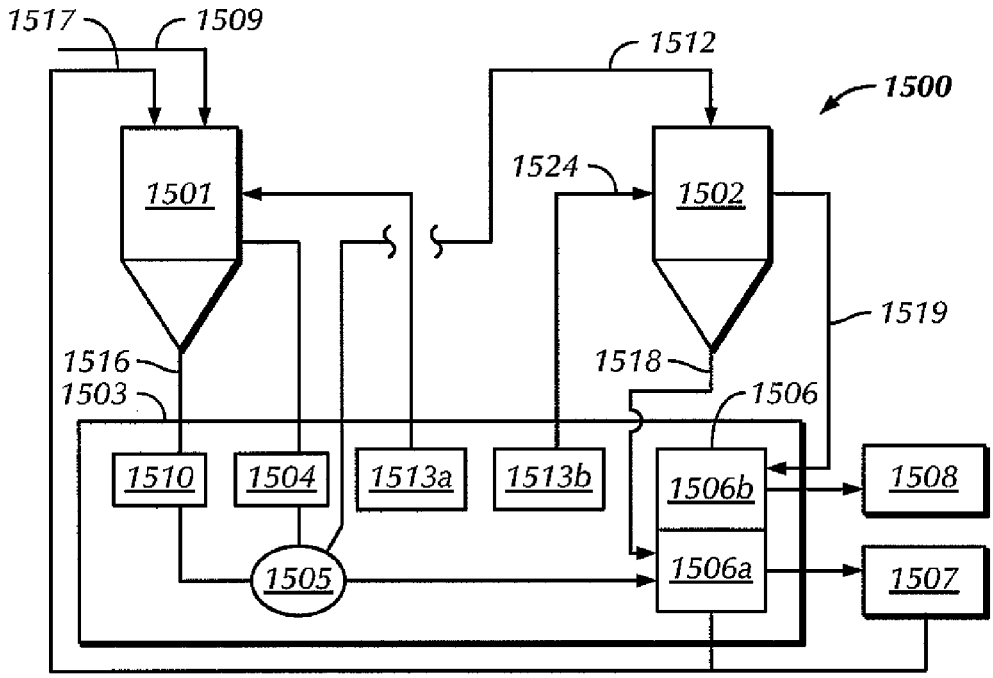

Referring now to FIG. 15, a system 1500 for recycling drilling fluid in accord with one embodiment of the present disclosure is shown. In this embodiment, system 1500 includes a first cuttings storage vessel 1501, a second cuttings storage vessel 1502, and a module 1503. Module 1503 includes a pump 1504, a valve 1505, dosing tanks 1513*a* and 1513*b*, and a filter system 1506. Valve 1505 provides for the control of fluid communication between first cuttings storage vessel 1501 and second cuttings vessel 1502 and/or drilling waste reservoir 1507. As described above, all structural elements including drilling waste reservoir 1507 and supply lines may be existing structures at a drilling location.

In this embodiment, a drilling fluid enters first cuttings storage vessel 1501 through a supply line 1509. The drilling fluid is allowed to separate in first cuttings storage vessel 1501 such that solid particles tend to settle toward the bottom of the vessel, while the less dense liquid phase of the drilling fluid separates toward the top of the vessel. This process may be facilitated by injecting chemical additives such as, for example, emulsion clearance agents from dosing tank 1513*a* into first cuttings storage vessel 1501. Examples of emulsion clearance agents that may be used in embodiments disclosed herein include, for example, anionic surfactants, nonionic surfactants, alkyl polyglycosides, and combinations thereof. Other chemical additives may be injected into first cuttings storage vessel 1501 including, for example, various surfactants and wettings agents, such as, fatty acids, soaps of fatty acids, amido amines, polyamides, polyamines, oleate esters, imidazoline derivatives, oxidized crude tall oil, organic phosphate esters, alkyl aromatic sulfates, sulfonates, and combinations thereof. Dosing of such chemical additives may vary according to the requirements of a given fluid recycling operation, however, those of ordinary skill in the art will appreciate that in certain embodiments, only minimal amounts of such additives may be used to achieve the desired result.

While drilling fluid separates in cuttings storage vessel 1501, the mixture may be agitated, as described above, or in certain embodiments using pressurized cuttings storage vessels, air may be injected into the mixture. The injected air may be controlled by a pneumatic control device (not shown) disposed on module 1503. In such an embodiment, an air line (not shown) from an air compressor (not shown) may be coupled to the pneumatic control device (not shown) on module 1503 to control a flow of air into first cuttings storage vessel 1501. Those of ordinary skill in the art will appreciate that air is only one additional example of a method to agitate the mixture in cuttings storage vessel 1501. Other methods may include stirring devices, water injection, chemical injection, heat, steam injection, or any other method of agitating a solution known in the art.

Still referring to FIG. 15, in this embodiment, when the mixture in cuttings storage vessel 1501 is separated to a desirable level, the solid cuttings waste that has collected toward the bottom of cuttings storage vessel 1501 is pumped out of the vessel via pump 1518 through line 1516. The mixture is then pumped through valve 1505, and if the mixture is in a positive condition, pumped directly to filter system 1506. In this embodiment, filter system 1506 is a compound filter module including a filter press 1506*a* and a hydrocarbon filter 1506*b*. The dense, generally solids component, may be further separated from any residual liquid phase, such that filter press 1506*a* directs the solids to drilling waste reservoir 1507, while directing any liquid phase back to cuttings storage vessel 1501 via a return line 1517. In certain embodiments, return line 1517 may be incorporated into module 1503, and the return of any such liquid phase from filter press 1506*a* to cuttings storage vessel 1501 may be facilitated with a pump (not shown).

When the mixture in first cuttings storage vessel 1501 reaches a negative condition, valve 1505 may be used to direct the mixture to cuttings storage vessel 1502 via line 1512. In this embodiment, a substantially liquid portion of the mixture in first cuttings storage vessel 1501, in a negative condition, may be pumped to second cuttings storage vessel 1502 for further processing by actuation of pump 1504, while valve 1505 directs the mixture through line 1512. As described above, should the condition of the mixture change (i.e., become positive), the mixture may be directed to filter press 1506*a*. In still other embodiments, those of ordinary skill in the art will appreciate that multiple valves similar to valve 1505 (e.g., R-valves), may be used to direct simultaneous flows of the mixture in first cuttings storage vessel 1501 to different components of system 1500, such as, for example, filter press 1506*a*, drilling waste reservoir 1507, or cuttings storage vessel 1502, at substantially the same time. Thus, in at least one embodiment, a valve system (not independently illustrated) may be foreseen that promotes the simultaneous processing of both positive and negative mixtures in first cuttings storage vessel 1501.

As the mixture is pumped via line 1524 into second cuttings storage vessel 1502, additional chemicals may be added to the mixture via a dosing tank 1513*b*. Examples of chemicals that may be added include anionic surfactants, nonionic surfactant, alkyl polyglycosides, wetting agents, surfactants, flocculants, and other chemicals that are known to those of skill in the art. Examples of the use of such chemical additives in a drilling fluid recycling system are described in U.S. Pat. Nos. 6,977,048 and 6,881,349, incorporated by reference in their entirety.

In system 1500, the mixture in second cuttings storage vessel 1502 may be further separated via chemical injection, as described above, through agitation, or through time-based separation. However, when separation occurs to a desirable level, the mixture may be removed from second cuttings storage vessel 1502 via line 1518. In this embodiment, the mixture in line 1518 may include a substantially solids mixture that may be in a positive condition, as described above, and as such, may be pumped into a filter press 1506*a*. Such a condition may exist in a system wherein chemical flocculant is injected into second cuttings storage vessel 1502, thereby creating flocs with a density greater than the mixture. However, in other embodiments, the solution in cuttings storage vessel 1502 is in a substantially positive condition, and solid sediment does not form. In such a system the mixture may be pumped from cuttings storage vessel 1502 into hydrocarbon filter 1506*b*, or may be pumped via an outlet in the side of second cuttings storage vessel 1502 through a secondary line 1519 to hydrocarbon filter 1506*b*. As described above, by providing a plurality of lines from second cuttings storage vessel 1502, the rate of drilling fluid processing may be increased.

Additional components for facilitating the removal of solid and oil components of the mixture may be added to system 1500 without departing from the scope of the present disclosure. Examples of such components may include hydrocyclones, centrifuges, and skimmers, which may be added as additional inline components during the direction of the mixture between first cuttings storage vessel 1501 and second cuttings storage vessel 1502 and components of module 1503. As such, those of ordinary skill in the art will appreciate that additional separation components may be added to module 1503, or may operate independent of module 1503, and still be considered a component of system 1500.

In certain embodiments, a multiple step chemical additive system including first dosing tank 1513*a* and second dosing tanks 1513*b* may be configured to provide for multiple step chemical injection. For example, first dosing tank 1513*a* may include separation chemicals, while second dosing tank 1513*b* may include flocculation chemicals. As such, dosing of a chemical to promote separation of solids and other particulate matter from the liquid phase may occur in first cuttings storage vessel 1501, while a flocculant is added from second dosing tanks 1513*b* to second cuttings storage vessel 1502. Those of ordinary skill in the art will appreciate that the addition of the chemical additives, including both separation and flocculation chemicals, may be controlled according to system parameters. Exemplary system parameters include a rate of separation and flocculation within the cuttings storage vessels, a rate of flow through the system, a volume of fluid within the system, and a weight of fluid within the system. Additionally, the chemical additives may be dosed according to such flow rates and/or according to volumes and weights of either the chemical additives or the fluids within the system. Furthermore, in certain embodiments, more than one separation and/or flocculation chemical may be added to either first or second cuttings storage vessel 1501 and 502.

After the mixture is processed by filter system 1506, the cleaned drilling fluid is directed to cleaned fluid reservoir 1508. The fluids may then be collected and/or used in other portions of the drilling operation, as described above.

Figure 16:
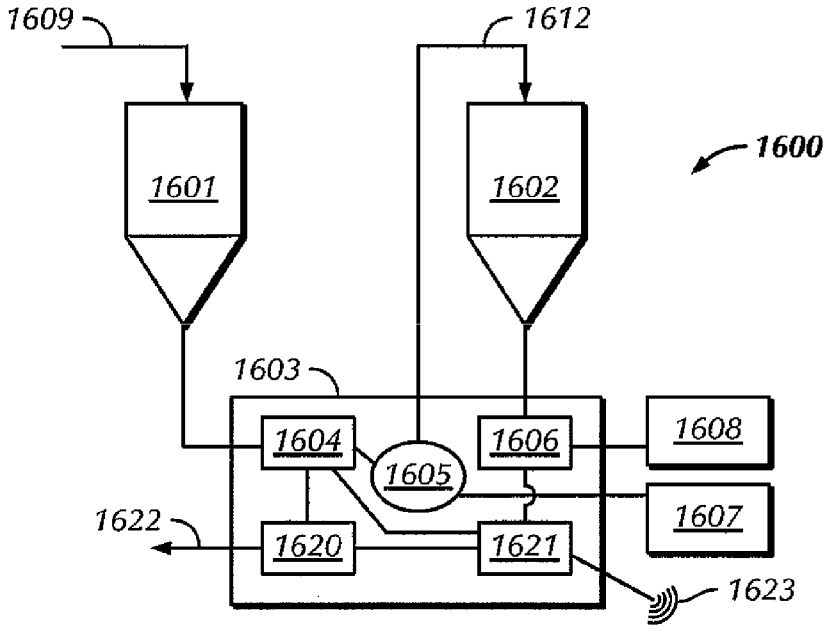

Referring to FIG. 16, a system 1600 for recycling drilling fluid according to one embodiment of the present disclosure is shown. In this embodiment, system 1600 includes a first cuttings storage vessel 1601, a second cuttings storage vessel 1602, and a module 1603. Module 1603 includes a pump 1604, a valve 1605, a filter system 1606, a power supply 1620, and a programmable logic controller ("PLC") 1621. Valve 1605 provides for the control of fluid communication between first cuttings storage vessel 1601 and second cuttings vessel 1602 and/or drilling waste reservoir 1607. As described above, all structural elements including drilling waste reservoir 1607 and supply lines may be existing structures at a drilling location.

System 1600 works similarly to systems 1300, 1400, and 1500, described above. Briefly, a drilling fluid enters first cuttings storage vessel 1601 through supply line 1609. The fluid is allowed to separate, and is pumped via inline pump 1604 to valve 1605. If the mixture from first cuttings storage vessel 601 is in a positive condition, the mixture is sent to drilling waste reservoir 1607, or otherwise directed to a press filter (not independently illustrated) of filter system 1606. If the mixture is in a negative condition, the mixture is directed to second cuttings storage vessel 1602 via line 1612. After further separation in second cuttings storage vessel 1602, the fluid is transferred to filter system 1606 for the additional removal of residual solids and/or hydrocarbons. The cleaned fluid is then directed to a cleaned fluids reservoir 1608 for use in other drilling operations.

In this embodiment, system 1600 includes an independent power source 1620 for providing power to components of module 1603. Power source 1620 is electrically connected to, for example, pump 1604, valve 1605, filter system 1606, and/or PLC 1621. Those of ordinary skill in the art will appreciate that such a power source may provide primary or auxiliary power for powering components of module 1603. In other embodiments, power source 1620 may be merely an electrical conduit for connecting a power source on a rig (not shown) via an electrical cable 1622, to module 1603.

System 1600 also includes PLC 1621, operatively connected to, for example, pump 1604, valve 1605, and/or filter system 1606. In this embodiment, PLC 1621 provides instructions for controlling the rate of flow of the mixture of first cuttings storage vessel 1601 through valve 1605 to, for example, second cuttings storage vessel 1602. Controlling the rate of flow may include controlling the operation of pump 1604 or valve 1605. In one embodiment, PLC 1621 may provide for the automated control of valve 1605, directing the flow of the mixture from first cuttings storage vessel 1601 to second cuttings storage vessel 1602. Such control may occur as a result of valve 1605 including a sensor. Examples of such sensors may include density sensors, conductivity sensors, or other sensors known to those in the art for determining a condition of a drilling fluid, such as, a density. Such an embodiment may allow module 1603 to automatically control the speed of the recycling of the drilling fluid to obtain an optimal condition for a drilling operation. An optimal condition may include cleaning a drilling fluid to a determined level for use in the drilling operation. Those of ordinary skill in the art will appreciate that such a system may be used to reduce the hydrocarbon content of a fluid to less than, for example, 20 ppm, to meet environmental regulations defining the condition for disposable fluids. In other operations, the hydrocarbon content may be reduced to substantially 35 ppm, and the fluid may be used in other components of the drilling operation. Those of ordinary skill in the art will appreciate that such hydrocarbon levels are merely examples of how such a system 1600 may be used to clean and recycle drilling fluids.

Still referring to FIG. 16, PLC 1621 may provide for external communication of module 1603 with a rig management system. Rig management systems may include, on-rig systems used to control drilling operations, drill cuttings cleaning operations, environmental systems, and data collection systems. As such, PLC 1621 may record and/or analyze data such as time of drilling fluid recycling, the amount of drilling fluid recycled, the amounts of chemicals used in the operation of system 1600, power usage, and other data that may be used by a drilling operator to further increase the efficiency of the drilling operation. In still other embodiments, PLC 1621 may allow module 1603 to be operatively coupled with other modules to use the cleaned fluids of system 1600 to, for example, clean tanks, re-inject cuttings into a wellbore, create slurry, or further remediate drill cuttings and/or fluids.

To promote such interconnectivity, module 1603 may include a data communication device, such as, for example, a wireless access point 1623, thereby allowing module 1603 and/or system 1600 to communicate remotely with other systems, modules, rig management systems, or other remote communication devices known to those of skill in the art. Such an access point 1623 may further allow module 1603 to be controlled, or data acquired therefrom remotely.

Those of ordinary skill in the art will appreciate that the components of systems 1300, 1400, 1500, and 1600 may be interchanged, interconnected, and otherwise assembled in a drilling fluid recovery system. As such, to address the specific requirements of a drilling operation, the components of the systems and modules disclosed herein may provide for an interchangeable and adaptable system for the cleaning and/or recycling or drilling fluids at a drilling location.

Combined Operations and/or Modules

As described above, cuttings storage vessels may be used in alternate unit operations where the cuttings storage tanks may be used sequentially for both cuttings storage/transport and for a second unit operation. Also as described above, the modules may convert one or more cuttings storage tanks for use in a second operation. Typically, rigs may use a cuttings storage vessel assembly, including multiple storage vessels, for cuttings storage. It may be desired to perform or to be capable of performing multiple operations simultaneously at a drilling location. For example, as described above, it may be desired to use some cuttings storage tanks for cuttings storage, while using other cuttings storage tanks in a slurrification process. Additionally, it may be advantageous to use a portion of the vessel assembly for cuttings storage while using another portion of the vessel assembly in a drilling fluid recycling operation. In this manner, drilling and cuttings separation processes and transport may continue while recovering drilling fluid, cleaning tanks, or grinding drill cuttings in a slurrification process. The smaller size for the system modules may allow for rig space to be conserved while gaining the ability to perform one or more of these operations. In some embodiments, multiple system modules may be used to convert cuttings storage vessels, cuttings storage vessel assemblies, or portions of cuttings storage vessel assemblies for use in one or more of these operations.

In one embodiment, a system module for converting cuttings storage tanks for use in alternate systems may include components for both a slurrification process and a drilling fluid recycling process. In another embodiment, a system module may include components for both a slurrification process and a tank cleaning process. In another embodiment, a system module may include components for both a tank cleaning process and a drilling fluid recycling process. In yet another embodiment, a system module may include components of a tank cleaning process, a drilling fluid recycling process, and a slurrification process.

In one embodiment, a system module including components for a drilling fluid recycling process and a tank cleaning process may include fewer components than would be required by simply combining the modules as illustrated in FIGS. 6-7 and FIGS. 13-15. For example, chemicals used in a tank cleaning process, such as surfactants, may also be used in a drilling fluid recycling process. Chemical addition devices may feed one or both of the processes, merely requiring a different fluid connection to be connected to a chemical addition device outlet, such as a tank cleaning machine or a cuttings storage tank. Additionally, each process may include a filter system, which may be used for one or both of the drilling fluid recycling process and the tank cleaning process. For example, settling efficiencies in the tank cleaning system may be such that a hydrocyclone is unnecessary; however, a filter press or hydrocarbon filter used in a drilling fluid recycling process may be useful in further separating compounds in the tank cleaning system. In this manner, the tank cleaning system may be operated without a hydrocyclone without concern for loss in separation efficiencies.

Advantageously, integration of vessels on the rig deck may minimize the size of the modular operations lifted to the deck. For example, a module for a tank cleaning operation may be made smaller due to the integration with existing vessels on the rig deck. Eliminating vessels from the module may allow for a smaller module, decreasing the size (width, height, and/or length) and the weight of the module. The decreased size may lower shipping costs associated with module transport, and may provide additional room on the supply ship for additional materials being brought to the rig or offloaded from the rig.

Advantageously, embodiments disclosed herein may provide a slurrification system that reduces the amount of required space at a work site to operate the slurrification system. In another aspect, embodiments disclosed herein may provide a slurrification system that reduces the amount of equipment or number of components required to prepare slurry for re-injection into a formation. In yet another aspect, embodiments disclosed herein may provide a safer slurrification system by reducing the number of crane lifts required to install the system.

Furthermore, embodiments disclosed herein advantageously provide a module configured to connect to a cuttings storage vessel on a drilling work site, thereby converting a cuttings storage vessel into a component of a slurrification system. As such, modules of the present disclosure may allow for existing infrastructure on an offshore platform to perform multiple functions, such as, allowing cuttings storage vessels to be used in both the storage and transfer of cuttings, as well as, being used in a slurrification system.

Advantageously, embodiments disclosed herein may provide for systems and methods that more efficiently clean and recycle drilling fluids on a drilling rig. Because offshore platform space is often limited, and crane operations to transfer drilling fluid cleaning systems are often expensive and dangerous, embodiments of the present disclosure may decrease the cost of drilling operations by decreasing the number of crane lifts. Additionally, modules of the present disclosure may allow for existing infrastructure of an offshore platform to perform multiple functions, such as, allowing cuttings storage vessels to be used in both the storage and transfer of cuttings, as well as, being used in a drilling fluid recycling operation. Furthermore, the system may promote the use of environmentally safe cleaning operations (i.e., recycling drilling fluid), thereby enhancing the environmental condition of the drilling operation. Finally, by decreasing time associated with changing drilling equipment for cleaning operations, the present disclosure may decrease downtime of a drilling operation, thereby increasing drilling efficiency, while decreasing cost.

Additionally, embodiments disclosed herein may advantageously provide for efficient use of deck space and equipment. Additionally, embodiments disclosed herein may minimize the number of lifts to or from a rig. The efficient use of equipment and decreased number of lifts may lower operating costs, may decrease the time required to change between rig operations, and may improve rig safety.

While the subject matter has been described with respect to a limited number of embodiments, those skilled in the art, having benefit of this disclosure, will appreciate that other embodiments can be devised which do not depart from the scope of the invention as disclosed herein. Accordingly, the scope should be limited only by the attached claims.

What is claimed:

1. A method for using a vessel assembly comprising two or more vessels in multiple drilling unit operations, the method comprising:

using at least one vessel in the vessel assembly for cuttings storage; and operating the at least one vessel in a slurrification system wherein operating the at least one vessel in the slurrification system comprises:

providing a fluid to the vessel;

providing cuttings to the vessel;

pumping a mixture of cuttings and fluid from the vessel through a grinding device; and returning the mixture to the vessel; and operating the at least one vessel in at least one of a drilling fluid recycling system; and a tank cleaning system.

2. The method of claim 1, wherein using the vessel for cuttings storage comprises transporting drill cuttings to the vessel via an inlet; and transporting drill cuttings from the vessel via an outlet.

3. The method of claim 2, wherein transporting drill cuttings to the vessel comprises at least one of pneumatic transfer, vacuum transfer, gravity transfer, and using a screw conveyor.

4. The method of claim 2, wherein transporting drill cuttings from the vessel comprises at least one of pneumatic transfer, vacuum transfer, gravity transfer, and using a screw conveyor.

5. The method of claim 1, wherein operating the vessel in a tank cleaning system comprises:

transferring tank slop to the vessel;

separating the tank slop to form a solids-rich fraction and a solids-lean fraction;

transmitting the solids-rich fraction from the vessel; and transmitting the solids-lean fraction from the vessel.

6. The method of claim 1, wherein operating the vessel in a drilling fluid recycling system comprises:

providing drilling fluid to the vessel;

mixing an emulsion clearance agent with the drilling fluid in the vessel to form a mixture;

filtering the mixture.

7. A method for converting a cuttings storage vessel for use in multiple operations at a drill site, the method comprising:

fluidly connecting a module to the cuttings storage vessel;

wherein the module comprises at least two of:

a tank cleaning conversion module;

a drilling fluid recycling conversion module; and a slurrification conversion module, wherein the slurrication module comprises;

a grinding device configured to facilitate the transfer of fluids;

an inlet connection configured to connect to an outlet of a first vessel of the vessel assembly disposed on a rig; and an outlet connection configured to connect to an inlet of the first vessel;

wherein the fluidly connecting converts the cuttings storage vessel to at least two of a tank cleaning system, a drilling fluid recycling system, and slurrification system.

8. The method of claim 7, comprising connecting at least two modules to the vessel assembly, wherein the at least two modules are selected from the group consisting of:

a tank cleaning conversion module;

a drilling fluid recycling conversion module; and a slurrification conversion module.

9. The method of claim 7, wherein the tank cleaning conversion module comprises:

a fluid connection for providing a fluid to a tank cleaning machine;

a chemical inductor for providing cleaning compounds to the fluid; and a fluid connection for transmitting tank slop from a tank being cleaned to the first cuttings storage vessel, wherein the tank slop is separated into a solids-rich fraction and a solids-lean fraction.

10. The method of claim 7, wherein the drilling fluid recycling conversion module comprises:

a valve for directing drilling fluid between a first vessel of the vessel assembly and a second vessel of the vessel assembly;

a filter system for filtering the drilling fluid; and at least one pump for facilitating the flow of the fluid between at least the first and second vessels.

11. The method of claim 7, further comprising connecting a power supply of the module to a power source.

12. The method of claim 7, further comprising connecting the module to a rig management system.

13. The method of claim 7, wherein the at least one module comprises:

a valve for directing a fluid between a first vessel of the vessel assembly and a second vessel of the vessel assembly; and a filter system for filtering the fluid.

14. The method of claim 13, wherein the multiple operations comprise a tank cleaning operation and a drilling fluid recycling operation.

15. The method of claim 13, wherein the filter system comprises at least one of a hydrocyclone, a hydrocarbon filter, a centrifuge, and a filter press.

16. A method for using a vessel assembly comprising two or more vessels in multiple drilling unit operations, the method comprising:

using at least one vessel in the vessel assembly for cuttings storage; and operating the at least one vessel in the vessel assembly in at least two of:

a slurrification system, wherein operating the at least one vessel in the slurrification system comprises:

providing a fluid to the vessel;

providing cuttings to the vessel;

pumping a mixture of cuttings and fluid from the vessel through a grinding device; and returning the mixture to the vessel;

a drilling fluid recycling system, wherein operating the at least one vessel in the drilling fluid recycling system comprises:

providing drilling fluid to the vessel;

mixing an emulsion clearance agent with the drilling fluid in the vessel to form a mixture;

filtering the mixture; and a tank cleaning system, wherein operating the at least one vessel in the tank cleaning system comprises:

transferring tank slop to the vessel;

separating the tank slop to form a solids-rich fraction and a solids-lean fraction;

transmitting the solids-rich fraction from the vessel; and transmitting the solids-lean fraction from the vessel.

17. The method of claim 16, wherein the operating the at least one vessel in the vessel assembly comprises fluidly connecting a module to at least one vessel.

18. The method of claim 17, wherein the module comprises at least one of a tank cleaning conversion module, a drilling fluid recycling conversion module, and a slurrification conversion module.

* * * * *